US008960108B1

(12) United States Patent
Lobik et al.

(10) Patent No.: US 8,960,108 B1
(45) Date of Patent: Feb. 24, 2015

(54) SYSTEM AND METHOD FOR COGENERATION FROM MIXED OIL AND INERT SOLIDS, FURNACE AND FUEL NOZZLE FOR THE SAME

(75) Inventors: James L. Lobik, Amherst, MA (US); Peter A. Howe, Westfield, MA (US)

(73) Assignee: SilverStreet Group, LLC, Westfield, MA (US)

( * ) Notice: Subject to any disclaimer, the term of this patent is extended or adjusted under 35 U.S.C. 154(b) by 0 days.

(21) Appl. No.: 13/331,086

(22) Filed: Dec. 20, 2011

Related U.S. Application Data

(60) Provisional application No. 61/424,908, filed on Dec. 20, 2010.

(51) Int. Cl.

| | |
|---|---|
| ***F23L 1/00*** | (2006.01) |
| ***F23G 5/00*** | (2006.01) |
| ***F23G 7/05*** | (2006.01) |
| ***F23D 1/00*** | (2006.01) |

(52) U.S. Cl.
CPC ..... *F23D 1/00* (2013.01)
USPC ..... 110/313; 110/257; 110/110

(58) Field of Classification Search
CPC ..... F23C 1/10; F23D 1/005; F23D 17/007; F23D 2204/30; F23G 7/05; F23G 7/14; F23G 2209/102; F23G 2209/12; F23G 2209/24; F23G 2900/70013; F23G 2900/7013; B05B 7/1486
USPC ..... 110/255, 257, 267, 293, 297, 313, 105, 110/110, 246, 104 B, 261, 262; 451/75, 451/102; 239/654, 675
See application file for complete search history.

(56) References Cited

U.S. PATENT DOCUMENTS

| | | | | | |
|---|---|---|---|---|---|
| 3,206,526 | A | | 9/1965 | Rygaard | |
| 3,709,170 | A | | 1/1973 | Van Gelder | |
| 3,817,697 | A | | 6/1974 | Parobek | |
| 3,958,518 | A | | 5/1976 | Yoshida | |
| 4,428,309 | A | * | 1/1984 | Chang | 110/262 |
| 4,441,434 | A | * | 4/1984 | Howard | 110/101 R |
| 4,501,205 | A | * | 2/1985 | Funk | 110/347 |
| 4,724,777 | A | * | 2/1988 | Reed et al. | 110/246 |
| 4,803,836 | A | | 2/1989 | Blanton et al. | |
| 4,887,962 | A | * | 12/1989 | Hasenack et al. | 110/263 |
| 4,958,578 | A | * | 9/1990 | Houser | 110/246 |
| 5,052,858 | A | | 10/1991 | Crosby et al. | |
| 5,117,771 | A | * | 6/1992 | Summers | 110/346 |
| 5,225,044 | A | | 7/1993 | Breu | |

(Continued)

*Primary Examiner* — Kenneth Rinehart
*Assistant Examiner* — David J Laux
(74) *Attorney, Agent, or Firm* — Loginov & Associates, PLLC; William A. Loginov

(57) ABSTRACT

This invention provides a system and method for efficiently and completely combusting oil in mixture with particulate solids. A furnace (kiln) having a feed nozzle with a lead screw drives the mixture from a feed hopper. This nozzle includes forced-air jets/ports at its tip providing makeup air and allowing atomization of the mixture. The nozzle thereby directs the mixture into a rotating combustion chamber that is tilted downwardly from the front toward a solid waste outlet port at the rear. Uncombusted fuel and air backflow to an upper, secondary chamber near the primary chamber front, and are completely combusted at a high temperature. Gasses exit a flue that can include a heat exchanger. This heat exchanger can be operatively connected to a heating device or other mechanism that converts the heat into usable energy. The nozzle can include a cone with axially tilted air ports about its perimeter.

20 Claims, 18 Drawing Sheets

(56) References Cited

U.S. PATENT DOCUMENTS

| | | | | | |
|---|---|---|---|---|---|
| 5,259,756 | A | | 11/1993 | Urza | |
| 5,261,602 | A | * | 11/1993 | Brent et al. | 110/347 |
| 5,553,554 | A | * | 9/1996 | Urich, Jr. | 110/211 |
| 5,555,823 | A | * | 9/1996 | Davenport | 110/346 |
| 5,616,023 | A | | 4/1997 | Mosci | |
| 5,680,822 | A | * | 10/1997 | Hallberg | 110/261 |
| 5,716,205 | A | | 2/1998 | Tratz | |
| 6,164,220 | A | * | 12/2000 | Magnusson | 110/246 |
| 6,164,809 | A | | 12/2000 | Hawkins | |
| 6,439,140 | B2 | * | 8/2002 | Mukai et al. | 110/347 |
| 6,672,751 | B2 | | 1/2004 | Hawkins | |
| 6,860,735 | B1 | | 3/2005 | Shimono | |
| 7,044,630 | B1 | | 5/2006 | Hawkins | |
| 2007/0151491 | A1 | | 7/2007 | Brown | |
| 2012/0103237 | A1 | | 5/2012 | Jones et al. | |

* cited by examiner

SYSTEM AND METHOD FOR COGENERATION FROM MIXED OIL AND INERT SOLIDS, FURNACE AND FUEL NOZZLE FOR THE SAME

RELATED APPLICATION

This his application claims the benefit of U.S. Provisional Application Ser. No. 61/424,908, filed Dec. 20, 2010, entitled SYSTEM AND METHOD FOR COGENERATION FROM MIXED OIL AND INERT SOLIDS AND FURNACE FOR THE SAME, the entire disclosure of which is herein incorporated by reference.

FIELD OF THE INVENTION

This invention relates to furnaces and kilns, and more particularly to systems and methods for cogeneration of steam for generation of electricity using waste-based fuel sources.

BACKGROUND OF THE INVENTION

As the demand for petroleum (oil) increases, and the supply of available petroleum declines, the world seeks ways to more efficiently and completely employ that supply in production of useable power—such as electricity generation. While great strides have been made in developing various alternate energy technologies, including nuclear, hydroelectric, wind and solar, fossil fuels still drive the majority of the world's electrical generators. Typically, such generators run on steam, which is heated by burning coal, gas or oil. Some generators employ direct gas turbine technology, but these are largely used in backup, and peak capacity roles. In the US, coal and natural gas are the primary fossil fuels employed in large-scale power generation. However, oil is an important source as well, particularly in smaller scale plants. Oil is also the key ingredient in the manufacture of many plastics and polycarbonates.

Supplies of high-grade crude oil are becoming scarcer, and the increasing price of oil has motivated drillers to pursue sources that are more costly to extract and contain higher degrees of waste products. One example is the extraction of oil from oil sands or shale, which entails significant energy in driving the oil from the sand/rock layers. In almost all combustion applications the oil must be essentially solid-free to be used as a fuel. This is because the combustion of oil typically entails injecting it through a nozzle into a combustion chamber to form an atomized mist that mixes with blown-in makeup air. Any suspended solids in the injected oil would clog the nozzle, and cake-up within the combustion chamber and exhaust system. Thus, simply combusting the solids and oil together is not practical.

More generally a typical oil well in many regions produces a mixture of oil, salt brine water and fines of dirt, dust and sand, referred to in the industry as SWD. This mixture is often referred to as "oil sludge". For example, the product of a typical developed producing well can consist of approximately a 50/50 mix of oil and water, with approximately 20%-30% oil-covered (or oil-impregnated) sludge. The water is a substantially salty brine, forming an emulsion of oil, water and salt. This sludge is withdrawn from the well with the oil product as production sludge throughout the life of the well. During production, the withdrawn oil is initially pumped from the well into a battery of storage tanks. Within these tanks, the sludge is allowed to settle to the bottom, and the oil product is periodically withdrawn and transported by a tank truck to a refinery. The storage tanks are periodically cleaned, with the bottom layer of settled sludge being removed by, for example, a vacuum truck. The sludge is then transported to a sludge pit. This is a typical technique for disposing of this byproduct, whereby the sludge is concentrated in sludge pits. The technique allows the water to settle as the emulsion breaks over one to two days. Some or all of the water is then allowed to evaporate, or it is actively separated-out by skimmers and pumps. Any separated water is then injected into a deep well. The sludge itself is trucked to a bury pit, mixed with enough fresh dirt to retain all the liquid oil residues, buried and the pit is eventually capped off, or simply left exposed. One reason no further processing is attempted is that the oil suspended in the sludge is challenging and costly to extract from the mixture.

Clearly, this is an unacceptable waste and abandonment of an energy-rich petroleum product, which has an energy density approaching 14,500 Btu per pound. By contrast the heat content of coal ranges from approximately 7,600 to 15,000 BTU per pound, evidencing the significant, foregone energy potential inherent in oil sludge. Moreover, the use of sludge pits presents a long-term environmental hazard that has the potential to endanger ground water supplies, animal life and human health. It is, thus desirable to provide a system and method that allows oil with suspended solids (clay, sand, shale, etc.) to be fully exploited for their energy value in, for example, the generation of steam that can drive an electrical generator and/or heating devices. The system and method should desirably handle the oil/solid mixture with minimal pre-processing of the mixture so as to avoid the application of excessive process energy in preparing the mixture for use as a fuel. Moreover, the temperatures at which this mixture is burnt to generate usable heat should be sufficient to ensure complete combustion, which in turn reduces harmful exhaust emissions.

SUMMARY OF THE INVENTION

This invention overcomes disadvantages of the prior art by providing a system and method for efficiently and completely combusting oil in mixture with particulate, generally inert, solids while delivering inorganic, landfill-ready solid components with virtually all toxic organic combustibles removed. The system and method employs a furnace (kiln) having a feed nozzle in the form of a lead screw that drives the mixture from a continuously replenished feed hopper. This nozzle includes a plurality of forced-air jets at a tip thereof that provide makeup air and allow for atomization of the mixture. The nozzle thereby directs the mixture into a combustion chamber that comprises a rotary kiln tapering from a larger inner perimeter adjacent to the nozzle to a smaller inner perimeter adjacent to a solid waste outlet port. The chamber is either stepped or continuously tapered and illustratively defines a polygonal cross section. It is tilted from a higher to lower elevation in a direction away from the nozzle. In this manner the injected mixture generates a fireball, rich in uncombusted oil, while the heavier solids (and remaining oil) land at the bottom of the combustion chamber, where they are agitated by the rotation and polygonal geometry. The remaining fuel in the solids burn out while they migrate down toward the outlet port. The heat and gasses generated by the fireball and the burning solids are directed via a backflow through a plenum adjacent to the nozzle and residing above it, into a second, higher-temperature combustion chamber that effects substantially complete combustion of the remaining materials therein. This chamber is fixed, and the gasses therein flow along it toward a flue. A heat exchanger is provided along the path of the combustion gasses through the flue to extract the heat content therefrom. This heat exchanger can be operatively connected to a heating device or other mechanism that converts the heat into usable energy. For example, the heat exchanger can be used to generate steam to run a local steam turbine and electrical generator. In the case of an oil sludge process, the generated electricity can be used to operate the oil field and/or deliver power to the distribution grid.

In an illustrative embodiment a furnace for combustion of a mixture of oil and particulate solids comprises a primary combustion chamber arranged along a longitudinal axis between a front and a rear, the primary combustion chamber rotating about the longitudinal axis and the longitudinal axis being tilted downwardly from the front to the rear. A secondary combustion chamber is provided, having a front and a rear, the front of the secondary combustion chamber being interconnected by a passage to the front of the primary combustion chamber. The rear of the secondary combustion chamber being interconnected to a flue. A nozzle assembly directs the mixture in combination with pressurized air into an air space at the front to the primary combustion chamber. The combusted mixture generates combusted gasses that flow through the passage into the secondary combustion chamber where they are further combusted and directed to the flue, the solids being directed to the rear of the primary combustion chamber to an outlet that can include an ash pit and a conveyor assembly. The nozzle assembly can include a rotating screw drive that feeds the mixture from a source and a plurality of ports surrounding the screw drive that communicate with a pressurized air supply. The screw drive can include a hollow shaft having a tip with ports, the shaft interconnected with a pressurized air supply. The ports can be constructed and arranged to selectively direct the pressurized air in a selected direction with respect to an axis of the screw drive, thereby allowing for a directional fireball within the primary combustion chamber's airspace. The flue is operatively connected to a heat exchanger constructed and arranged to generate process steam, which in turn can be used to operate an electrical generator. A gas blower can be operatively connected to the rear of the primary combustion chamber, and another blower can be operatively connected to the front of the secondary combustion chamber. A controller receives temperature sensor information from a plurality of locations within the furnace and that controls operation of the nozzle assembly and other operational components of the furnace based upon the information produced by the temperature sensors. The primary combustion chamber can define a plurality of sections that each decrease in size from a frontmost section to a rearmost section or a tapered structure that decreases from a larger perimeter at the front to a smaller perimeter at the rear. The cross section of at least some of the sections can be polygonal. Likewise, the cross section (taken on a plane normal to the longitudinal axis) of the tapered sections can be polygonal. This geometry assists in churning the burning slag and ash from the mixture.

In an illustrative embodiment, a nozzle assembly for feeding a mixture of solid particulates and oil to a combustion location under pressure comprises a screw feed that rotates at a predetermined rate to direct the mixture from a source location down a screw feed casing to a tip from which the mixture is ejected. A plurality of air ports surround the tip, at location external of screw feed casing. The ports direct pressurized air in a selected quantity into the mixture as it is ejected from the tip. An igniter that directs a pilot flame into the mixture as it is ejected from the tip. The air ports are located between the screw feed casing and an outer casing coaxial with the screw feed casing. The air ports are constructed and arranged to direct the compressed inwardly toward a rotational axis of the screw feed. Alternatively, the air ports comprise a plurality of discrete directional ports interconnected with respective hoses. The directional ports can be interconnected, respectively, with selectively controlled, pressurized air sources. A controller can selectively operate the sources, which can include valves that thereby cause the overall airflow to be directionally directed. This allows the fireball generated by the nozzle to be steered. The feed screw can include a hollow central shaft in communication with a source of pressurized air and having a plurality of air ports at a tip thereof that directs the pressurized air into the mixture as it is ejected from the tip.

In an illustrative embodiment, the nozzle assembly can also include a nozzle cone that is disposed about the tip and that extends beyond the air ports. The nozzle cone can be adjustable as to its pitch or allow for removable attachment of nozzles with differing pitch values, and comprises a conical section and a port section, the conical section extending beyond the air ports and the port section supporting the plurality of air ports. The ports are tilted angularly with the angle of tilt substantially matching the pitch of the conical section. The ports may have both a radial tilt relative to the lead screw longitudinal axis and an axial tilt relative to the lead screw longitudinal axis. In further embodiments, the nozzle of this, and other embodiments can be configured to direct a flame at an acute angle with respect to the rotational axis of the kiln.

BRIEF DESCRIPTION OF THE DRAWINGS

The invention description below refers to the accompanying drawings, of which.

DETAILED DESCRIPTION

I. Furnace Structure and Function Overview

Figure 1:
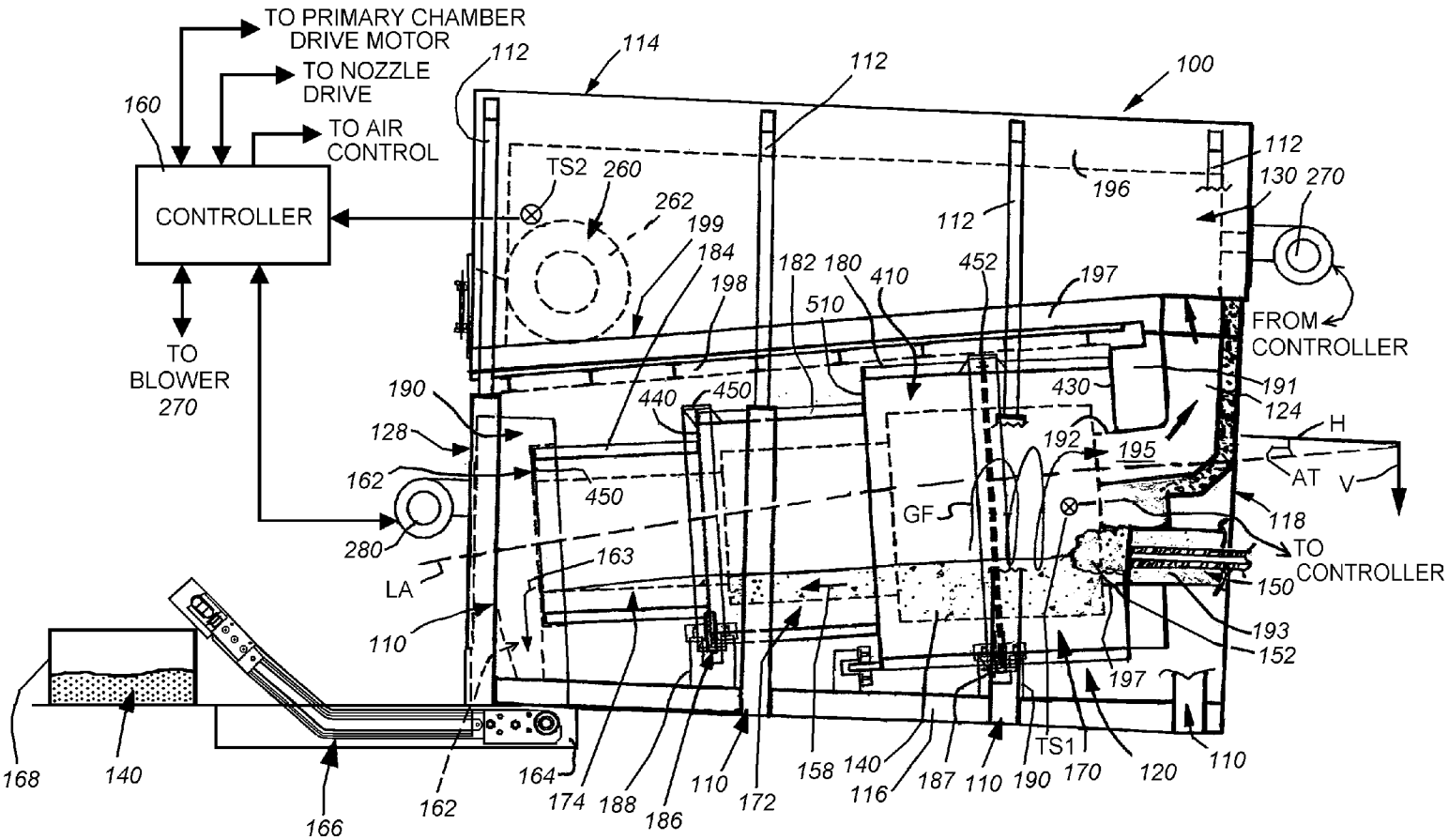
FIG. 1 is an exposed side view of a furnace for cogeneration of process steam and disposal of oil-containing solid materials, such as oil sludge, according to an illustrative embodiment.
Figure 2:
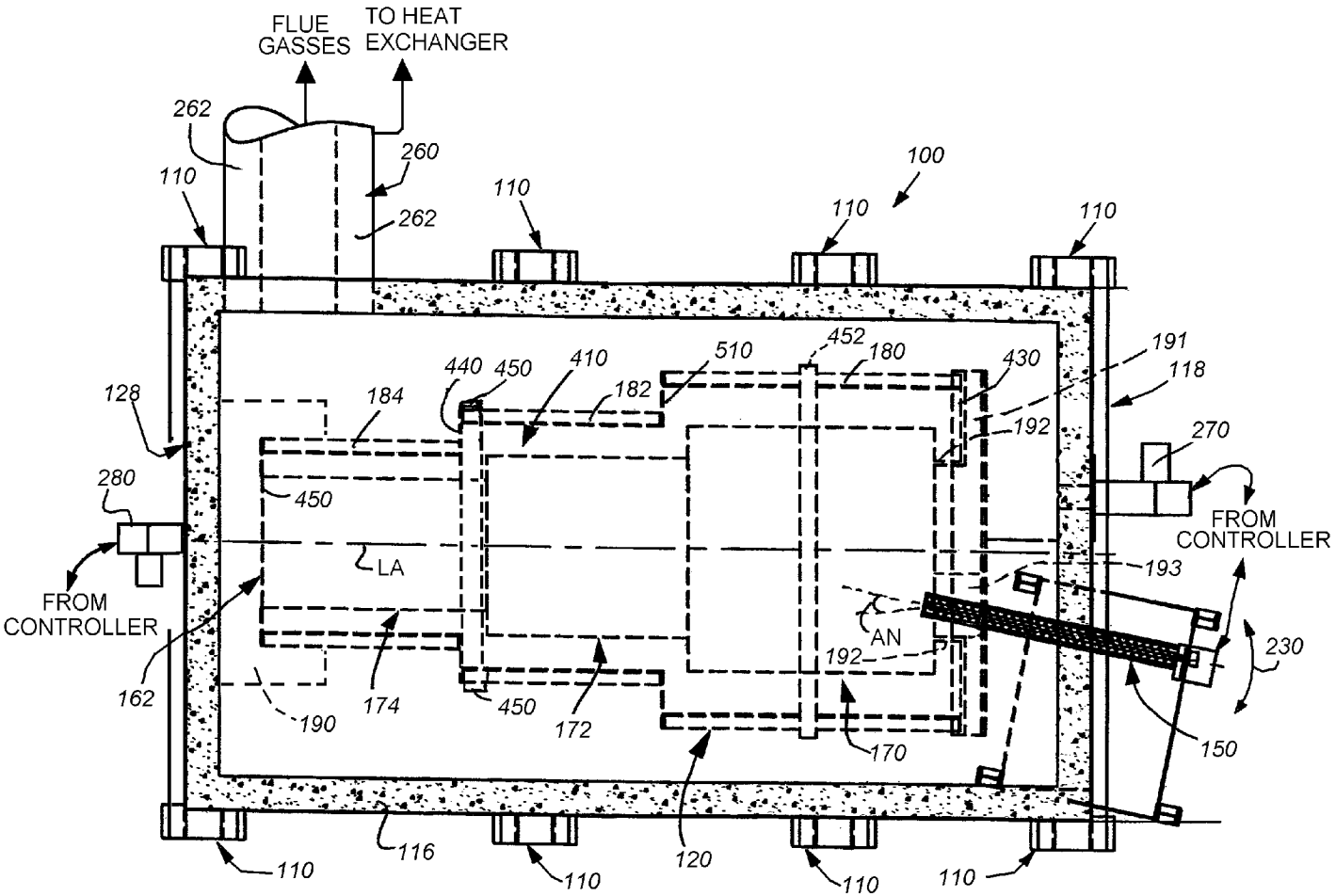
FIG. 2 is a an exposed top view of the furnace of FIG. 1 showing the illustrative positioning of the rotating primary combustion chamber and feed nozzle assembly with respect to the furnace base and framework, according to an embodiment.
Figure 3:
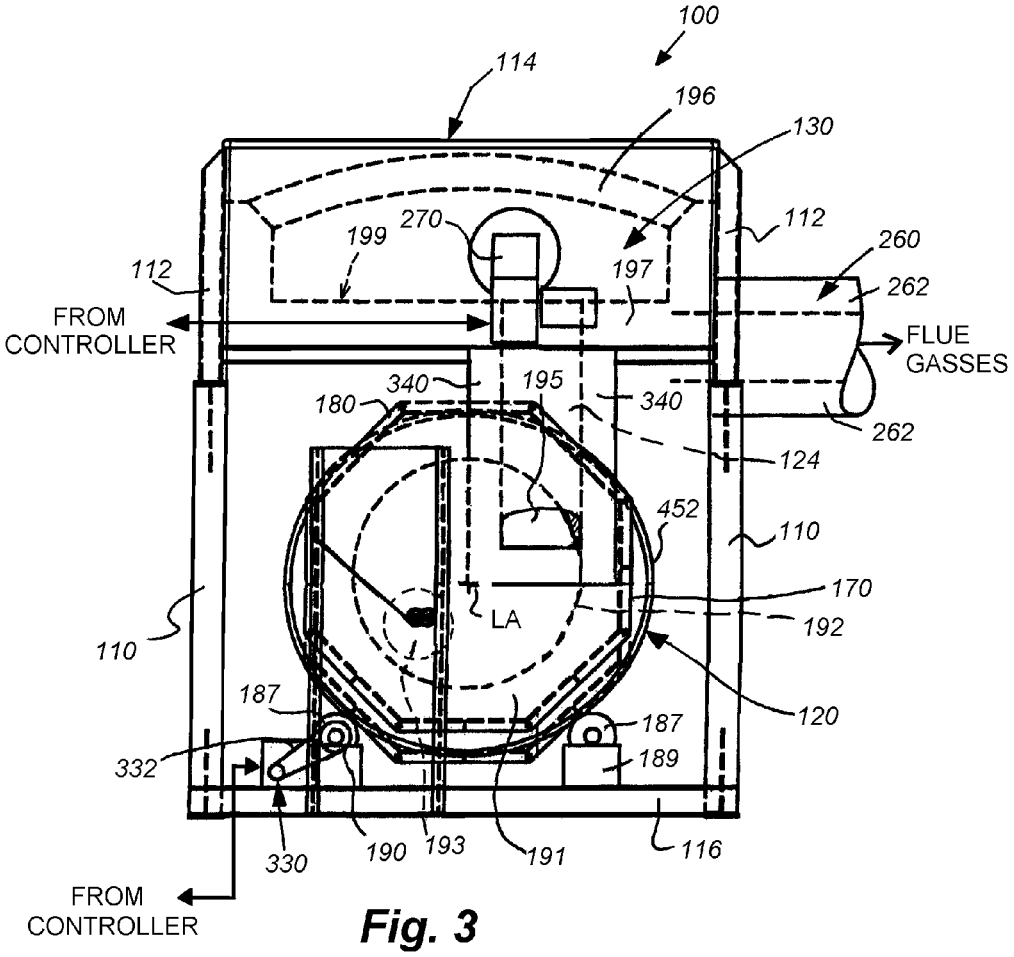
FIG. 3 is an exposed frontal view of the furnace of FIG. 1.

A furnace (also termed a "kiln") 100 in accordance with an illustrative embodiment is shown in FIGS. 1-3. The furnace is shown in partially exposed side, top and frontal views for clarity. In various embodiments it can include appropriate covers for motors, gears and other key components. The furnace 100 includes a frame consisting of a plurality of spaced-apart posts 110 that can comprise steel beams of the appropriate size and cross-sectional shape. The posts 112 support a series of vertical upper posts 112 that extend to the top side 114 of the furnace 110. A base, constructed from steel stringers, or a concrete slab 116. The base 116 and overlying framework 110, 112 collectively contain the furnace's combustion components. Illustratively, the lower portion of the furnace 110 consists of a rotating combustion chamber (primary chamber) 120. This primary chamber 120 is interconnected via a passage 124 at the front end 118 of the furnace 100 to an overlying secondary combustion chamber (secondary chamber) 130. Note, as used herein directional and orientational terms such as "upper", "lower", "front", "rear", "top", "bottom", "vertical" and "horizontal" should be taken as relative indications of orientation and not as absolute conventions with respect to the direction of gravity or another coordinate system.

The primary combustion chamber 120 is oriented along a rotational axis (also the chamber's longitudinal axis) LA that is tilted with respect to the horizontal H (perpendicular to the vertical V—the direction of gravity) so that the axis LA at the front 118 is higher than axis rear 128. While the angle of tilt TA is highly variable, in an illustrative embodiment it is in the range of approximately 3° to 25°. As described further below, the tilt angle enables the burning solids 140 (shown as debris at the bottom of the chamber) to migrate toward the rear 128 of the furnace from a location adjacent to the front 118 in which most are dropped by action of the fuel-air nozzle assembly 150. The nozzle assembly 150 according to various embodiments is described in further detail below various embodiments. Briefly, the nozzle in this embodiment defines a screw feed system that transports the mixture of oils and solids at a relatively high rate to the primary chamber 120, in which it is mixed with high-pressure air so as to at least partially atomize the mixture and cause it to ignite in a fireball 152. The fireball 152 ejects solids that are mixed with some oil. These fall to the bottom of the chamber near the front, where they continue to burn in contact with the injected air within the chamber. The solids form a hot, burning slag that is driven progressively down the length of the chamber to the rear. The driving of the slag results from a downward gravitational vector resulting from the tilt angle TA. The slag is particularly urged by the continued rotation of the chamber about the rotational axis LA. In an embodiment, the chamber rotates about the axis at a rate of between approximately ½ and 40 RPM. Although the actual speed can vary, and can be controlled by a controller (consisting of processors, hardware, software, etc.) 160 based upon the sensed operational parameters (temperature, fuel flow, etc.) of the furnace—in other words, how rapidly the slag is being accreted and how quickly it needs to be removed from the chamber. As the slag moves along the chamber (arrow 158) due to the tilt and rotational action, it is churned and continuously exposed to ambient air. This causes the remaining combustibles (oil, etc.) to burn as it moves toward the rear. The slag near the rear is virtually free of flammables and significantly cooler than that near the front.

At the rear of the chamber 120 is an outlet 162 through which the expended solids pass as they migrate (arrow 163) from the rear end 164 of the chamber via gravity and rotation. The outlet leads to a pit 164 beneath the furnace base 116 that can be filled with water in order to provide an air seal relative to undesired air infiltration into the rear end of the chamber. The pit can include a conveyor assembly 166 or any other acceptable mechanism for moving the spent solids to a remote location for disposal. One such location 168 is a bin 168 that can be transported to a disposal site when full. Alternatively one or more conveyors (of any type) can be employed to transport spent solids to a transport vehicle (dump truck, hopper car, etc.) or disposal site (e.g. an ash pit or tailing mound). As described further below, the resulting solids are virtually free of volatile flammable compounds and other potentially toxic organic compounds, which—due to the long heat exposure, churning and high burn temperature—are virtually all combusted and/or volatilized from the solids before they reach the rear end 162.

Figure 4:
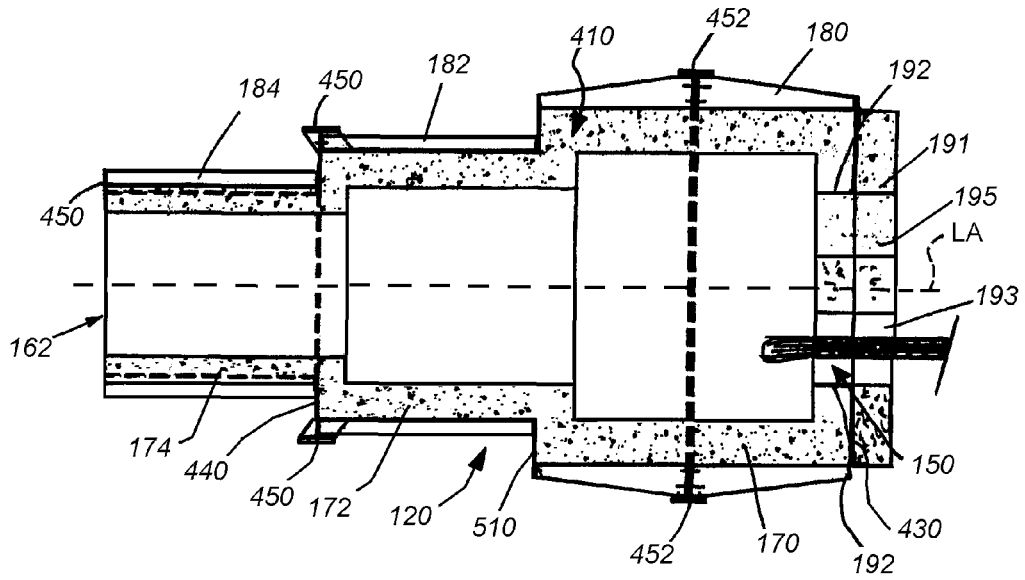
FIG. 4 is a side cross section taken through the vertical centerline of the primary combustion chamber of FIG. 1.

With further reference to the side cross section of FIG. 4, the structure of the primary chamber 120 according to one or more illustrative embodiments is described in further detail. The chamber 120 consists of a series of novel, decreasing-perimeter step segments 170, 172 and 174. Each step segment provides a lip adjacent the previous section (in a front-to-rear direction), over which the solids 140 must pass as they migrate down the chamber. This slows their motion while allowing better mixing, and prolongs burning and extraction of combustibles from the ash. In addition, the steps provide for a large airspace/airflow volume near the most aggressive combustion activity at the front and less airspace where combustion and burning temperatures are reduced at the rear (i.e. where the slag is mostly exhausted). The chamber in this embodiment is lined with a heat-resistant layer of ceramic material—typically a commercially available refractory material 410. However, in alternate embodiments, other types of materials suitable for the interior of a furnace (including certain high-temperature metals) can be employed. The refractory material 410 chamber can comprise a commercially available, castable or a commercially available refractory that is molded and fitted to form the desired interior shape of the 120 using known techniques. The thickness of the refractory (or other heat-containing/insulating liner material) along the longitudinal surface and at the step junctions is highly variable. In general, the thickness should be sufficient to ensure that the generated heat is substantially contained within the chamber itself. In an illustrative embodiment it is desirable that the refractory material be securely fastened so that it endures rotation. Likewise the thickness of the material is highly variable and based upon the size and operating temperatures of the chamber. In general, several inches of refractory (3" to 14" inches, for example), should be sufficient to provide an appropriate heat-resistant liner to the chamber.

Figure 5:
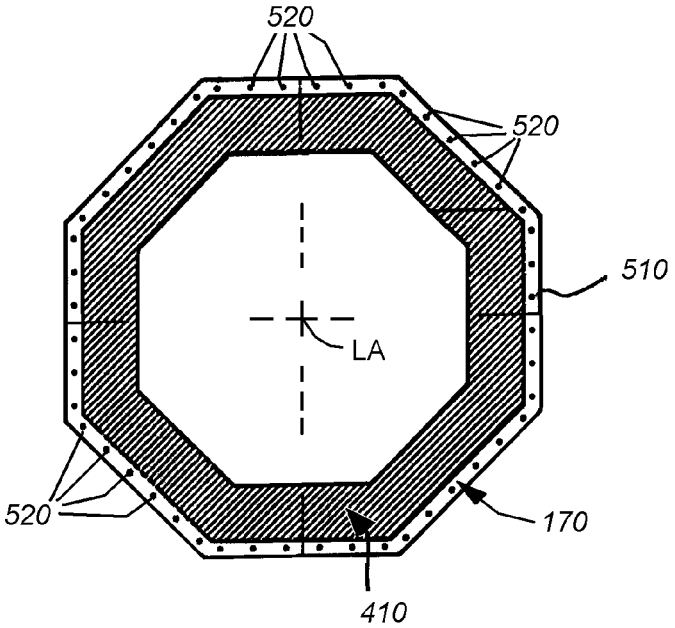
FIG. 5 is a front view of a bulkhead for supporting plating/frame members that carry refractory material in the front sections of the primary combustion chamber of FIG. 4.
Figure 6:
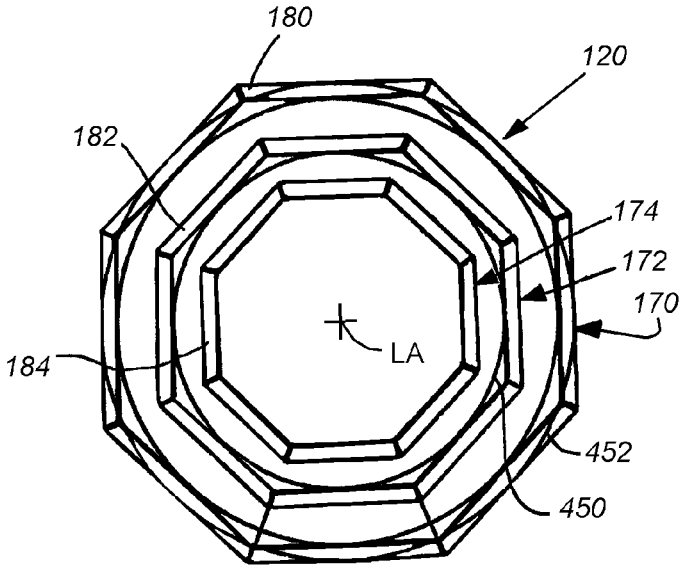
FIG. 6 is a simplified front view on the supporting plating/framework for each of the three steps of the primary combustion chamber of FIG. 4.

With reference also to FIGS. 5 and 6, the refractory is (410) typically attached to outer plating 180, 182 and 184 that is, itself, joined on opposing ends to bulkheads or appropriate size, such as the bulkhead 510 shown in FIG. 5. Note that each bulkhead includes a series of through holes 520 for fastening that plating (180 in this depiction) at its opposing edges using, for example, bolts or equivalent fasteners. A variety of alternate fastening techniques for joining holes and plates can be used. As further shown in FIG. 6, the plating is arranged in three steps 180, 182 and 184 of decreasing radius (perimeter size). Each step, in this embodiment, comprises a novel polygonal shape, which is also provided in the brick inner surface. The bulkheads (510, 430, 440, 450), likewise provide this polygonal outline. The polygons decrease in diameter by several inches per step (for example, 4 to 8 inches between steps). The polygons, are concentric (relative to the axis LA) regular octagons in this embodiment, but can be a variety of shapes in alternate embodiments. For example, the sides can be partially curvilinear. It is desirable generally with this inner surface shape that the inner corners between sides (facets) act to churn the solids so that they are agitated. This causes more air-mixing as the solids migrate down the chamber, leading to higher burn efficiencies. Note that the polygonal, or other geometric shape, can vary along the length of the chamber in alternate embodiments. For example, the geometric cross section shape of each step can vary (e.g. an octagon at the frontmost step, a hexagon at the middle step and a circle at the rearmost step. Moreover, the number of steps is highly variable and a number greater than or less than three can be employed. Likewise, one or more steps can be tapered along their individual lengths, as described generally below.

In an embodiment, thus, the refractory bricks (410) or equivalent structures are attached to the plating 180, 182, 184 using threaded bolts (not shown) that are anchored in the outer (facing away from the chamber) surfaces of the respective bricks and pass through corresponding holes in the plating to be secured by mating nuts (also not shown) along the exterior of the plating. In this manner the bricks remain in place on the chamber wall, but can be readily replaced by unbolting the old brick and bolting-on a new brick as needed. This attachment arrangement can be accomplished in accordance with ordinary skill. Note also that plating can be perforated or an open framework structure (metal stringers, etc.) can be substituted for plating in an alternate embodiment. Bricks or castable are secured to such a framework and the framework is likewise secured to each bulkhead.

The overall rotating, primary chamber 120 is supported on a series of roller assemblies 186, 187 that extend from vertical bases 188, 189 and 190 mounted to the furnace base 116. The design of these roller assemblies and bases is highly variable. In an illustrative embodiment, at least four contact points along the length of the furnace are provided for such roller assemblies. These contact points are placed on opposing sides of the bottom of the furnace to cradle it. The contact points reside in the approximate mid-section (lengthwise) of the frontmost step 172 and at the rear end of the middle step 172. The chamber 120 includes metal rings/tires 450 and 452 at these locations, which engage the roller assemblies. At least one roller assembly includes a drive assembly 330 (FIG. 3), which powers the rotation, by driving the associated roller. The remaining rollers act as idlers in this arrangement. The rotation drive motor is typically powered by electricity, pneumatics or hydraulics, rated to provide appropriate torque. The motor can include a gear reduction as appropriate and an associated drive chain assembly 332. The motor can receive appropriate signals from the controller 160 so as to regulate speed and provide a failsafe mechanism in the event of overload or jamming. In this embodiment, the dive is interconnected with the rear tire 452. In alternate embodiment, other tires can be connected or an alternate system—for example a driven chain that surrounds a sprocket, or a circular gear rack, on the perimeter of the chamber—can be employed.

The rotating, primary chamber 120 is also supported by journals (or other support structures that enable rotation while stabilizing radial movement) at its opposing front and rear ends. In an embodiment, the rear end 162 is rotatably supported by the rear outlet housing 190. The outlet housing allows rotation of the combustion chamber 120, while minimizing passage of gases/air through the interface therebetween. A variety of moving seals or other structures according to conventional principles can be used to provide an acceptable seal between the rotating and stationary elements. A minimal amount of air infiltration is generally acceptable in various embodiments.

The front end of the combustion chamber includes a cap 191. The geometry of the cap 191 is highly variable. In general, the cap 191 projects into a central port defined by an annular shoulder 192 formed in the rear of the combustion chamber 120 and overlaps the shoulder's edges. The interface between the shoulder and the cap 191 defines a seal, which minimizes air infiltration through the interface as the chamber rotates—although minimal air infiltration is typically acceptable. In this embodiment, the front end of the chamber is unsupported by the cap 191, being instead supported by the engagement between the metal tires and rollers. The cap 191 is part of an overall structure that can be secured to the outer furnace framework 110, 112 and/or base 116. The stationary cap structure 191 can include a plurality of ports that will be described variously below. These ports generally allow for the introduction of fuel and air and the expulsion of hot exhaust gasses, while maintaining a seal between the rotating combustion chamber and the ambient environment. That is, the ports are located within the bounds of the stationary cap structure and the chamber rotates around them.

The lower port 193 is located at any accept position to allow passage of the feed nozzle assembly 150 into the combustion chamber 120. The passage can include a variety of seals and gaskets that reduce transfer of heat to the outside environment. As shown the positioning of the nozzle assembly with respect to the chamber is variable (double curved arrow 230 in FIG. 2). In this example, the port 193 is located remotely from the longitudinal axis LA, and the nozzle assembly is directed at an acute angle AN with respect to the longitudinal direction. This arrangement can be beneficial to create a vortex within the chamber 120 for increased burn efficiency and greater gas flow/mixing through the chamber. In alternate embodiments the nozzle can be aligned parallel or with the longitudinal axis LA. Likewise, the port 193 can be located/centered on a vertical plane (centerline) through the longitudinal axis. In various embodiments, the port can be adapted to allow for physical adjustment of the nozzle's direction in rotational degrees of freedom normal to the horizontal plane and/or to the vertical plane. In other embodiments, the nozzle is generally fixed in angle with respect to the combustion chamber 120. As described further below, in various embodiments, the airflow with respect to the nozzle can be used to adjust the direction of projection of the fireball. The construction of the nozzle assembly, according to various embodiments, is also described in further detail below.

The cap 191 contains at least one other port 195 in this embodiment leading to the vertical passage 124 described above. The port 195 can be located at a variety of positions with respect to the overall cap dimension. In an embodiment, it is located offset from the vertical plane (centerline) through the longitudinal axis LA (see FIG. 3) on a side opposite the nozzle inlet port 193. In alternate embodiments the port 195 and associated vertical passage 124 can be located on the longitudinal axis' vertical plane/centerline. The shape of the port 195 is highly variable. It can be circular, ovular, polygonal or an irregular shape. In this embodiment, it defines a rectangle with arched top. The passage 124 can define any acceptable cross section shape, such as a rectangle. It is lined with refractory material 340 (or is cast as a hollow conduit from one or more sections of such material).

The passage 124 leads vertically upward to the secondary combustion chamber 130. This chamber 130 is also lined with refractory material 196, 197, or another appropriate material for containing heat and insulating the area. In an embodiment, the chamber defines a rectangular cross section with an arched top. The refractory material can be cast sections or bricks that are attached to external plates or engage external frame members. Alternatively, the bricks can be constructed as a freestanding structure with minimal reinforcement. A framework 198 of elongated and crossing beams supports the secondary combustion chamber 130 in a suspended position above the rotating primary combustion chamber. In an illustrative embodiment, the floor 199 of the chamber 130 is tilted downwardly toward the rear at an angle that substantially matches the angle of tilt AT of the longitudinal axis LA. The top (114) of the chamber 130 is horizontal, thereby creating an increasing volume in the rearward direction. A flue 260, also lined with insulating material 262 is positioned at the side of the secondary chamber, adjacent to the rear.

Based upon the above-described arrangement of chambers, fuel/air inlets, passages and flues, the flow of material through the furnace 100 can be described as follows—(a) fuel is driven through the nozzle, mixed with pressurized atomizing air at the exit end of the nozzle as a partially atomized mixture in the front of the primary chamber 120 this partially atomized mixture is ignited by a burner located at the screw exit end of the nozzle so as to form a fireball (152). This fireball is directed to generate an appropriate flow through the chamber 120. Fuel impregnated solids fall out of the fireball due to gravity and are churned to enhance full combustion as they migrate toward the outlet 162 as spent ash and slag. The narrowing steps 180, 182, 184 of the primary chamber cause the majority of heat and airflow to occur in the front portion of the chamber, while cooler burning solids transfer hot gasses from the narrowed regions, back toward the wider front. This backflow is a novel arrangement that causes a "rich" mixture of burning fuel, air to flow through the port 195 and into the upper, secondary chamber 130 via the passage 124. In the secondary chamber, the hot gasses burn at a substantially higher temperature (for example a minimum of 1500 degrees Fahrenheit in the secondary chamber versus 900 degrees Fahrenheit in the primary chamber). This high temperature is contained by the secondary chamber's insulative layers. It ensures substantially complete combustion of the mixture as it flows rearwardly toward the flue (into the higher-volume, rear portion of the secondary chamber). When reaching the flue, the hot gas mixture is largely $CO_2$, water vapor and residual air, with other byproducts being largely consumed. As described further below, the flue gasses comprise a heat source that can be channeled through one or more heat exchangers so as to extract thermal energy therefrom. The heat exchangers can create process steam to power a steam turbine for cogeneration of electricity and other useful work. Other tasks such as water distillation (e.g. desalination) can be accomplished using the heat in addition to (or in an alternative to) power generation.

With further reference to FIGS. 1-4, the operation of the furnace 110 is regulated by the controller 160, which can be any acceptable control mechanism including an electronic device, an electromechanical device, a general purpose computer employing software and associated interface peripherals or a combination of such modalities. The controller 160 receives signals from several data sources. One such source provided by temperature sensors within the two combustion chambers 120, 130. In an embodiment, a temperature sensor TS1 is located at or near the primary combustion chamber front. It detects the combustion chamber near the fireball. This assists in determining the proper feed rate for fuel from the nozzle and the appropriate air to add into the mixture. The exact positioning of the sensor TS1 is highly variable. Moreover, a plurality of sensors can be provided at various locations in the combustion chamber 120. A second sensor TS2 monitors temperatures in the secondary chamber 130. In an embodiment, it is located near the flue 260, but can be located at any appropriate position within the secondary chamber. Each sensor in the overall array relays useful information to the controller 160 regarding the current status of the combustion profile. The primary chamber sensor TS1 can relay temperature information used by the controller 160 to increase or decrease fuel and air. This sensor can also affect the drive speed of the rotation motor 330. The secondary chamber sensor TS2 can be used to determine whether sufficient temperature to drive combustion is present in the upper chamber 130. If sufficient temperature is absent, then a gas/air blower 270 at the front of the chamber 130 can be operated to increase the heat of the chamber. The gas can be any flammable gas, such as methane or propane. Likewise, if the temperature in the secondary chamber rises too high, the sensor TS2 will instruct the nozzle assembly 150 to feed at reduced rate so as to avoid overheating or runaway combustion, which can destroy the furnace.

An air/gas blower 280 is also provided at the rear of the primary combustion chamber 120, passing through the outlet housing 190 and opening into the rear end 162. This blower 280 operates based upon the controller's instructions. Operation of each blower 270, 280 can be controlled to vary the amount of gas/air transferred into the furnace. Each blower includes a conventional igniter (not shown). When the temperature in the primary chamber is too low to sustain combustion at the nozzle, then the blower 280 directs a burning fireball into the chamber so as to increase the temperature to a spontaneous combustion point. Once this temperature level is achieved, the blower 280 can be instructed to deactivate, based upon the reading of temperature sensor TS1. Either blower 270, 280 can operate to provide only makeup air to the burning fuel by reducing or shutting off the flammable gas flow (via an electromechanical, controlled valve—not shown). While not shown, various other sensor types, such as oxygen level sensors and carbon-monoxide level sensors, can be interconnected to the controller 160 and positioned to monitor the status of the combustion and vary the fuel-air mixture accordingly.

In an embodiment, the objective combustion temperature in the secondary chamber 130 is maintained at a minimum of 1500° F. This temperature level helps to assure complete combustion while minimizing the formation of undesirable oxides of nitrogen in the flue gas stream.

More particularly, it is known in the art that, stoichiometric or perfect combustion requires air/gas ratios of about 10:1. Perfect combustion also yields the highest temperature. The addition or subtraction of air to each chamber thereby affects the efficiency of the combustion process occurring therein. As combustion becomes "rich", meaning that there is less air in the process and more uncombusted fuel, rich (from perfect combustion) the combustion temperature declines. If the process becomes lean (from perfect combustion), meaning that there is too much air present, then the temp also declines. Illustratively, the combustion in the primary chamber occurs in a starved oxygen atmosphere. The resulting flue gas that flows through the passage into the secondary chamber is therefore very rich in unburned fuel as it is fed to the secondary chamber. By way of example, the air/gas ratio in the primary chamber can be in the range of 5:1 to 7:1—being just enough air to support combustion. This is one reason that the temperature in the primary combustion chamber is relatively low.

Much of the temperature control in the secondary chamber is achieved by controlling the amount of fresh air (commonly referred to as "excess air") introduced to the rich gas stream entering the secondary chamber from the primary chamber. In operation, the temperature within the secondary chamber can potentially be controlled using only the addition of fresh air via the blower. Thus, the addition of flammable/fuel gas to the front of the secondary chamber can be optional or omitted in various embodiments as a mechanism for increasing the combustion temperature in the secondary chamber. Rather the richness of the mixture, combined with the volume of air added to the secondary chamber, can suffice to achieve an increased temperature in the presence of the appropriate air/fuel ratio (approximately 10:1) for perfect combustion. More generally, the blower serves to add fresh air so as to operate the secondary chamber in an excess air state. To this end, the controller and local temperature sensors modulate the blower, if needed, to reduce the amount of fresh air being injected to increase the temperature of the secondary chamber (in the event it is running too lean). Likewise, the amount of air added by the blower can depend upon the ratio of the fuel/air mixture being produced in the primary chamber.

II. Furnace with Alternately Shaped Primary Combustion Chamber

Figure 7:
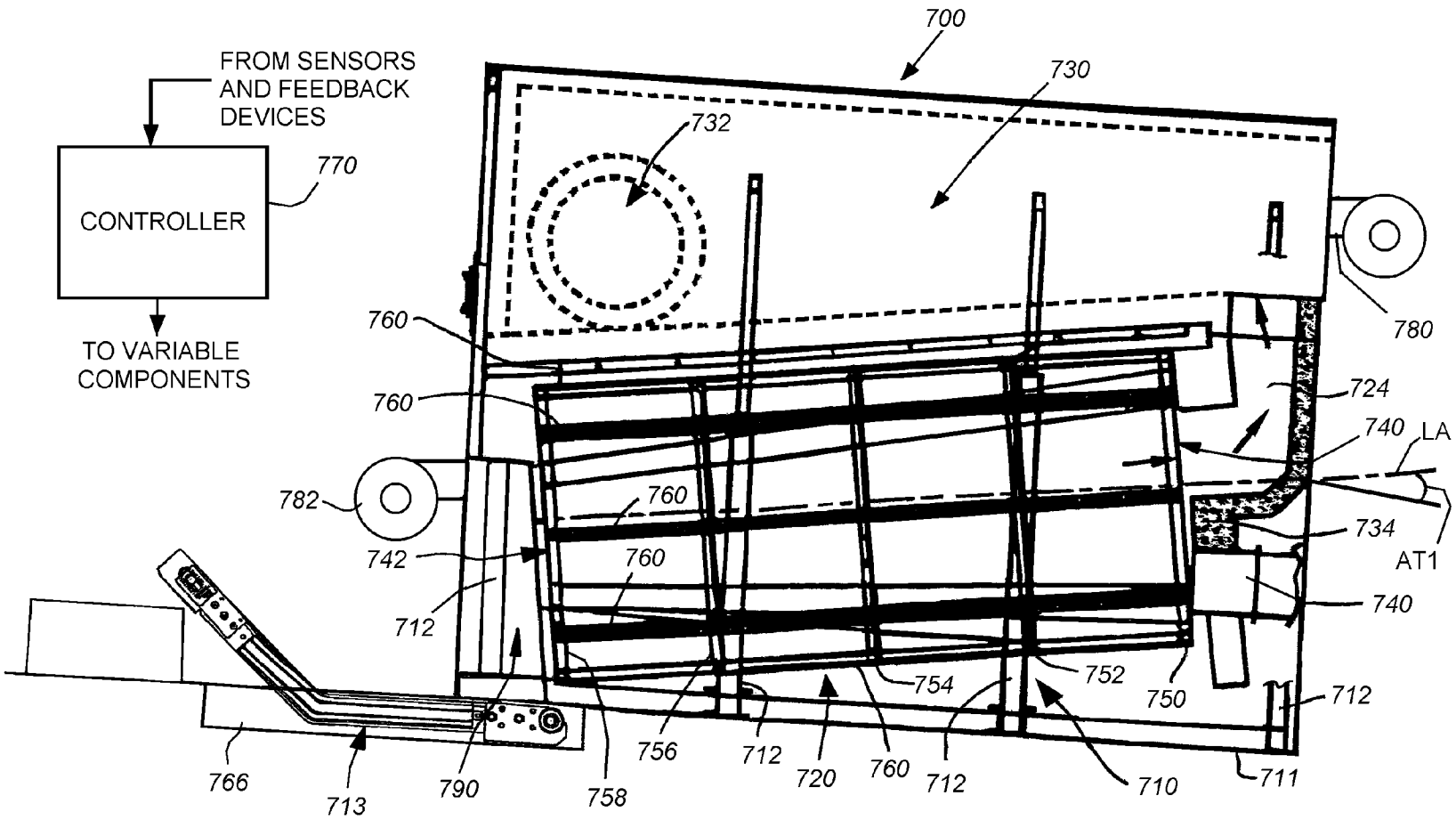
FIG. 7 is an exposed side view of a furnace for cogeneration of process steam and disposal of oil-containing solid materials, such as oil sludge, according to another illustrative embodiment in which the rotating, primary combustion chamber defines a tapered, continuous polygonal shape.

As described above, the rotating, primary combustion chamber is highly variable in geometry, and size. As shown in FIG. 7, the furnace 700 is constructed similarly to the above-described furnace 100. Similar elements to those described above have been omitted for clarity. In general, it includes a framework, with a base 711 and upright posts 712. An outlet conveyor assembly 713 for spent solids is provided. An upper, secondary chamber 730 is connected to a flue 732 that vents hot exhaust gasses for use in steam generation and other appropriate operations. The secondary chamber 730 communicates via the vertical passage 724 with a port in the cap 734 at the front end of the rotating, primary combustion chamber 720, according to another illustrative embodiment. Another port 740 provides a passageway for the fuel nozzle in a manner described above. The cap 734 provides a stationary interface with respect to the rotating rim of the primary chamber 720, thereby permitting fuel and air to enter the chamber, and rich exhaust gasses to exit into the overlying secondary chamber 730, where complete, high-temperature combustion and process heat production occurs.

Figure 8:
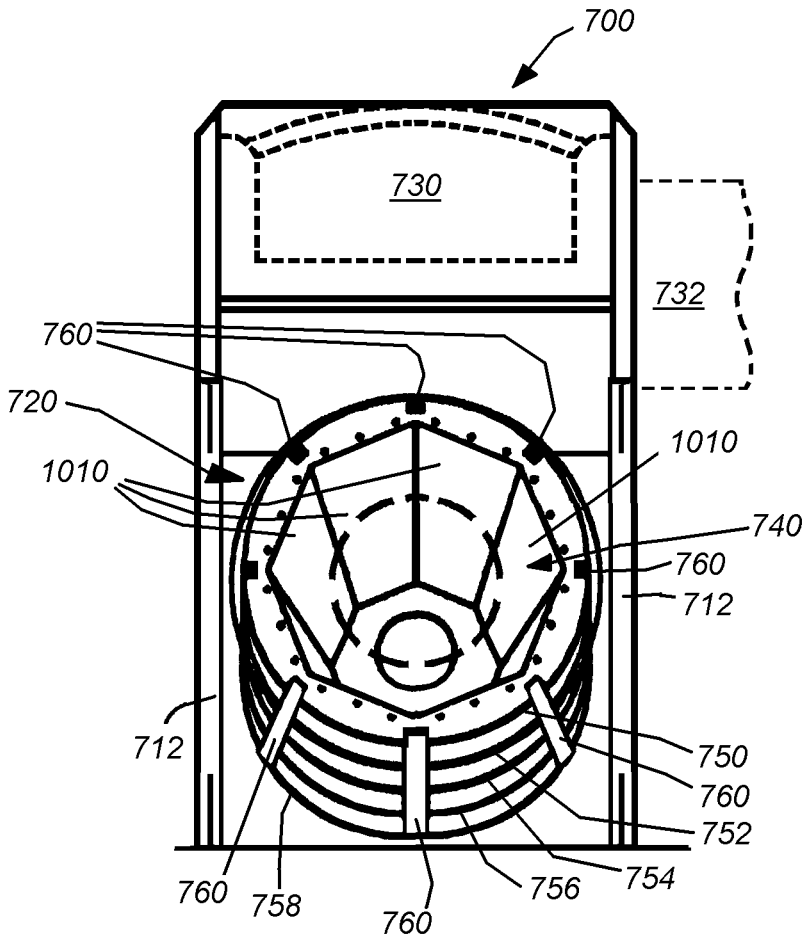
FIG. 8 is an exposed frontal view of the furnace of FIG. 7.
Figure 9:
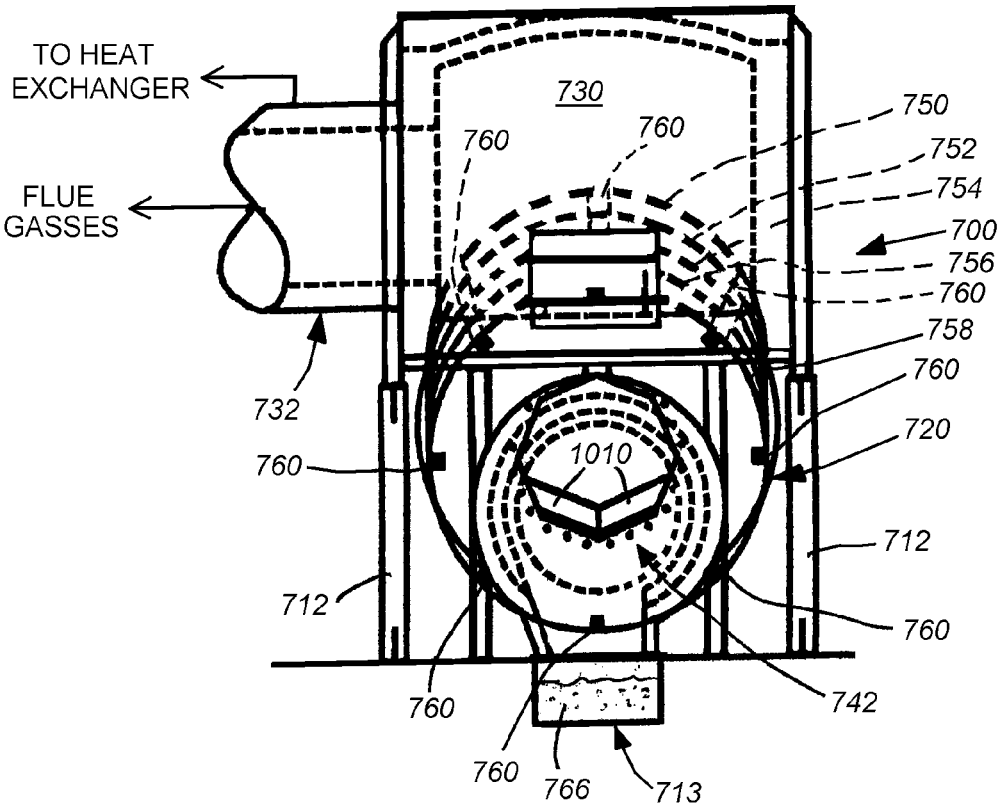
FIG. 9 is an exposed rear view of the furnace of FIG. 7.
Figure 10:
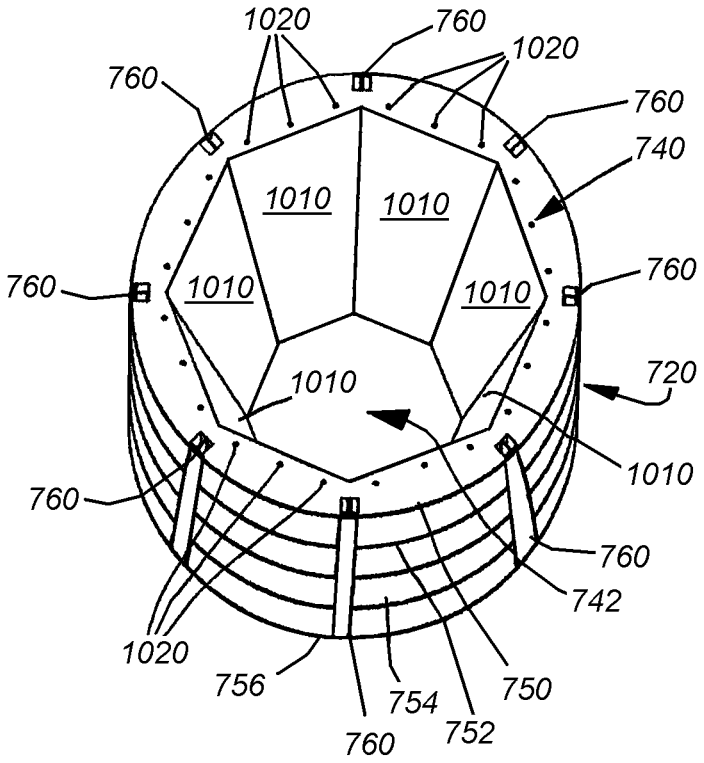
FIG. 10 is a perspective view of the primary combustion chamber of the furnace of FIG. 7 detailing the tapered polygonal shape of the interior thereof.

With further reference to FIGS. 8-10, the primary combustion chamber 720 according to this embodiment is shown in further detail, positioned in the furnace 700 (FIGS. 8 and 9) and taken separately (FIG. 10). The chamber 720 in this embodiment comprises a continuous tapered interior extending from a large perimeter at the front 740 to a small perimeter at the rear 742. The interior surface comprises a plurality of shaped panels 1010 that define a frustum (polygonal cone) having a regular octagonal or hexagonal cross section. In general the number of sides in the polygonal cross section is highly variable, and the polygon can consist of 5, 6, 7, 8 or more sides as appropriate. While regular polygons are employed in various embodiments, irregular polygons can be employed in alternate embodiments of either the continuous or stepped versions of the primary chamber. This shape is free of steps (unlike the chamber 120 in FIG. 1), but is angled downwardly at an angle AT1 that is similar to the above-described angle AT. In an embodiment, the angle AT can be between 5 and 25 degrees. The chamber's taper angle can be between approximately 3 and 10 degrees with respect to the longitudinal axis LA1 in an embodiment.

The panels 1010 comprise a refractory material that can be provided in molded sections. The panels can be attached to plating or an open framework as described above with respect to the chamber 120. The support plating or framework is attached to bulkheads via bolts and through holes (for example holes 1020 in FIG. 10). In this embodiment, the outer perimeter of each of the bulkheads 750, 752, 754, 756 and 758 is an equal-radius circle. The inner, octagonal aperture of each bulkhead varies in size, based upon the position along the continuous tapered structure. The bulkheads in this embodiment provide a circular outer rim, each with a similar radius so that the external detail of the chamber 720 defines a generally continuous cylinder. A series of stringers 760 are welded or fastened into conforming grooves in each outer rim at a regular arc length around the perimeter. These stringers illustratively maintain the bulkheads in a spaced-apart relationship and provide integrity to the overall chamber structure. The cylinder is supported on rollers or other moving supports (not shown), and can be similar in structure and function to the support arrangement for the primary chamber 120 of FIG. 1. In this manner, the chamber 720 is rotated at the desired speed to cause ash and slag to migrate down the tapered interior in the manner described above. The taper causes a large airspace near the front where air exchange is most aggressive and rich gasses are backflowed up the passage 724 to the primary chamber. The airspace is smaller near the rear where the remnants of spent slag are directed to the outlet conveyor assembly via the water trough 766. The operation of the furnace 700 in this embodiment is controlled by a controller 770 that functions similarly to the controller 160 described above. That is, the controller 770 receives temperature and other status data from sensors and feedback devices (e.g. motor controllers, steppers, etc.) and provides control signals to variable components such as the rotation drive motor, the nozzle assembly and the gas/air blowers 780, 782.

Note that the interface between the cap structure 734 and the front 740 of the primary chamber 720 operates similarly to that of the furnace 100, described above. Likewise, the interface between the outlet housing 790 and the rear 742 of the primary chamber is similar in function and structure. In general air infiltration at both locations is minimized by use of overlapping lips and the like, between each end of the rotating chamber 720 and the stationary cap and outlet structure. The overall support for the chamber 720 is provided by the tires and rollers, or another mechanism.

It should be clear that a wide range of variations of the shape and size of the primary chamber are expressly contemplated. By way of example, a 5 MW generation system may employ a furnace with a primary chamber that is sized in length between 8 feet and 16 feet, and an average inner diameter between 4 and 8. However, these values are only exemplary, and actual dimensions can vary based upon measured performance. The size of the furnace and amount of feed material throughput generally determines the furnace's energy output within a given range of minimum and maximum sizes. To this end, the dimensions of the furnace and associated generation system can be scaled up or down to increase or decrease total output in a manner clear to those of skill in the art.

III. The Nozzle Assembly

The effective combustion of a mixture of flammable oils and particulate (non-combustibles) relies substantially on a nozzle assembly that can effectively atomize this mixture so that air and fuel can comingle and maintain combustion. This generally requires that a mechanism for transporting the mixture apply sufficient pressure to cause that materials in the mixture to become suspended in mid-air as they exit the end of the nozzle and remain suspended long enough to significantly combust. In a liquid fuel arrangement, this is accomplished by a pump and a small aperture liquid nozzle that creates an aerosol fuel composed of tiny droplets that readily mix with blown-in make-up air. However, the presence of solids limits the effectiveness of a small aperture nozzle. It would become clogged by the variably sized solid particles. Thus, in the illustrative embodiments, the nozzle assembly transports the oil and solid mixture using a helical screw encased within a close-fitting cylindrical housing.

Figure 11:
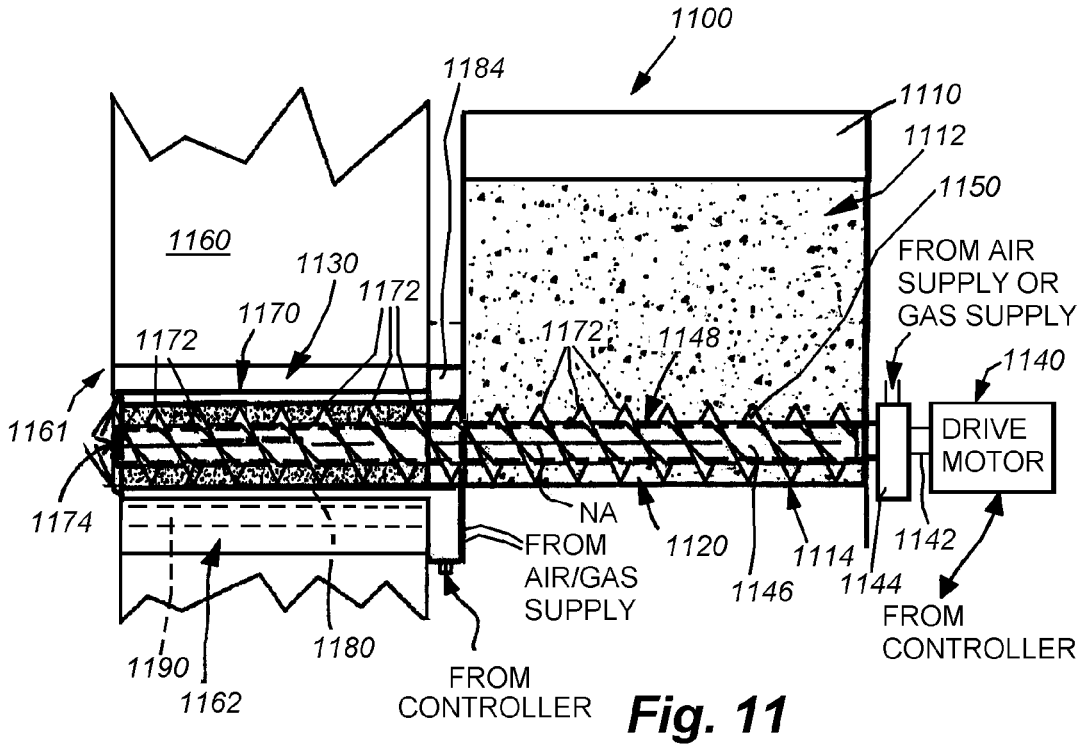
FIG. 11 is a side view of a nozzle assembly according to an illustrative embodiment.
Figure 12:
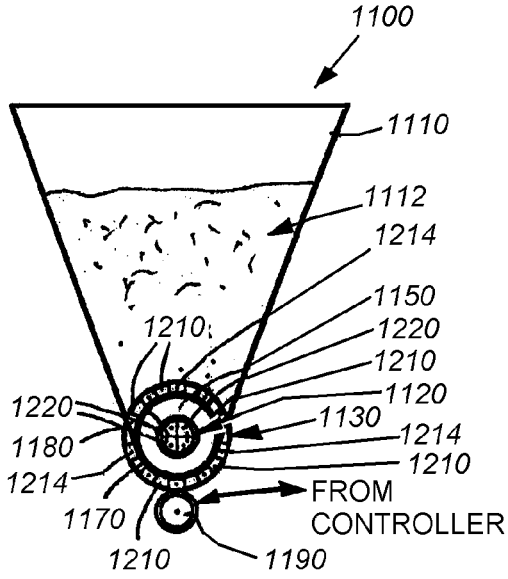
FIG. 12 is a rear, downstream, view of the nozzle of FIG. 11 depicting the nozzle tip.

Reference is made to FIGS. 11 and 12, which show an embodiment of a nozzle assembly 1100. Note that any of the various nozzle assemblies described hereinbelow can be used in conjunction with the illustrative furnace 100, 700 described above (or in conjunction with any other variation on the furnace contemplated herein). Thus, the generalized nozzle assembly 150, previously described can be substituted with one of the following embodiments. In the depicted embodiment, the assembly 1100 consists of a funnel-shaped hopper 1110 that maintains a relatively continuous level of the solid and oil mixture 1112. The level of material is highly variable, but is generally maintained so that there is continuous coverage of the upstream end of the feed screw 1120 according to this embodiment. Additionally, the level should provide sufficient weight to ensure that the material is continuously urged by gravity into engagement with the feed screw 1120 as it is carried downstream out of the hopper 1110. Material is replaced by a second conveyor that can draw material from a larger source (delivered by truck, for example) and provide it in response to the current level in the hopper 1110. This second conveyor (not shown) can be any acceptable design including a slurry pump and hose, a feed screw and/or a belt conveyor. The amount of feed material maintained in the hopper can be determined by experimentation for a given feed rate, and based upon the size and shape of the feed screw.

The geometry of the hopper 1110 defines a wide top and a bottom 1114 that is curved to conform to the cylindrical outer dimension of the screw 1120. In this manner, all the material is driven by the weight of the overlying material into pressurable engagement with the screw. It should be clear that a variety of mechanisms for ensuring the screw is properly fed can be implemented in alternate embodiments. For example, a biased piston or plate can be used to force material into contact with the screw.

In an embodiment, where the amount and density of solids in the oil and solid mixture sent to the hopper is low enough to constitute a semi-liquid feed material, an agitator device (not shown) operatively connected to the hopper can be used to assist in keeping the solids in suspension as the feed material is supplied to the feed screw. It should be clear that a variety of agitation devices can be employed, such as an agitating beater that rotates within the hopper, or a shaker that vibrates the hopper.

In an illustrative embodiment the feed screw is driven by a drive motor assembly 1140 that receives drive signals from the controller so as to variably control its speed and operation. The motor can be any acceptable motor with appropriate reduction gears and/or power transmission components. The motor 1140 is typically electrically driven, but other types of motors (such as hydraulic or compressed air motors for example) can be employed in alternate embodiments. The motor 1140 is interconnected to a drive axle 1142 that extends into a sealed air feed coupling 1144. This coupling 1140 allows pressurized air from a supply (for example an electric air compressor—not shown) to be injected into the hollow center 1146 of the feed screw shaft 1148, which exits downstream of the coupling. Appropriate bearings and seals that should be clear to those of ordinary skill are used to provide the coupling in an embodiment.

The exterior of the feed screw shaft 1148 supports a continuous helical strip 1150 that is secured to the shaft 1148 by welding or another acceptable technique. Stainless steel or another durable material can be employed form both the helix 1150 and the shaft 1148. Alternatively, the screw 1120 can be constructed as a unitary member using machining techniques or another acceptable manufacturing process.

The feed screw 1120 extends the length of the hopper 1110, and exits downstream into a casing 1130 that passes through the cap 1160 at the front of the primary chamber 1161 via a port 1162. The casing 130 includes an inner cylinder 1170 that closely conforms to the outer edge of the helix 1150, thereby containing the mixture 1112 between the helix lands 1172 as the screw rotates to drive the mixture downstream to the nozzle tip 1174. The casing 1130 also includes a coaxial outer shroud 1180, which is separated from the inner casing 1170 by a set of spacers 1210. The spaces are located at selected positions about the perimeter of the casing. They generate channels in communication with a distribution header 1184 that receives air and/or flammable gas from the compressor or air supply. A set of ports are located between spacers 1210. They direct pressurized air and/or gas into the fuel mixture as it exits the nozzle tip under pressure due to the momentum imparted by the rotating feed screw 1120. In an embodiment, some or all of the ports 1214 can be independently fed with gas and/or air so that the bias of pressurized air/gas exiting the casing 1130 can be varied. In an embodiment, the ports are fed by individual hoses or tubes connected to an air compressor, and optionally serviced by separate valves (not shown). For example, more pressure can be applied at one side of the nozzle than another, allowing the creation of a directional fireball and/or vortex within the combustion chamber. In this embodiment, the ports 1214 are bored so as to direct their flow inwardly toward the central axis NA of the nozzle. The availability of flammable gas to inject into the combustion stream can allow for supplemental heat generation when furnace is started, or to maintain a combustion level when the mixture is incapable of maintaining the needed temperatures.

As described above, the screw shaft 1148 is hollow so as to receive a flow of pressurized air (and/or gas) supply. This flow exits the shaft at the tip via a plurality of ports 1220 that are located around the perimeter of the shaft tip. These ports provide further make-up air and help to impel the ejected mixture into the airspace of the combustion chamber 1161. The pressure and airflow utilized is highly variable. The precise levels of pressure and airflow can be determined experimentally for a given size and output of furnace and specific characteristics of the feed material. They can be varied based upon the measured temperature and other parameters within the furnace by the controller (160, 770). More particularly, a plurality of variables is accounted for in determining pressure, mixture feed rate, and other operational parameters. These variables include, but are not limited to, (a) water content and temperature of the fuel/solid mixture (feed material) fed through the nozzle, (b) the proportion, density and particle size of the noncombustible components of the feed material, volatility of the combustibility portion of the feed material, (c) the temperature and relative humidity of the ambient air, (d) the rate at which the system is being fired, and (e) the HHV (BTU content) of the feed material as well as the diameter of the nozzles air port nozzles. In an embodiment, the operating pressure range of the nozzle air ports can be between 20 and 90 psi. In practice, the parameters can be set to customized values for a given load of feed material based upon the observed performance of the furnace, including various sensor readings of temperature, flue gas composition and the like.

Also shown is an igniter assembly 1190, which receives signals from the controller in order to activate an electrical spark. This igniter is used to initiate furnace combustion in a manner known to those of ordinary skill. It typically includes a flammable gas source that provides a pilot flame. This pilot flame, in turn, ignites the feed material. The gas-fueled pilot fireball generated by the igniter is desirably large enough to raise the temperature of the atomized feed stream from the nozzle (i.e. oil, solids and pressurized air) to a temperature in excess of its flash point. It is contemplated that the flash point for a feed material composed of oil sludge is in the range of 250° F. to 350° F., and the pilot is designed to achieve this temperature level within the front end of the chamber in proximity to the feed material. Once achieved, the igniter can be deactivated as the chamber temperature rises and the ignition of the feed material becomes self-sustaining. In this embodiment, it is located beneath the casing 1130, but can be positioned at other appropriate locations.

Figure 13:
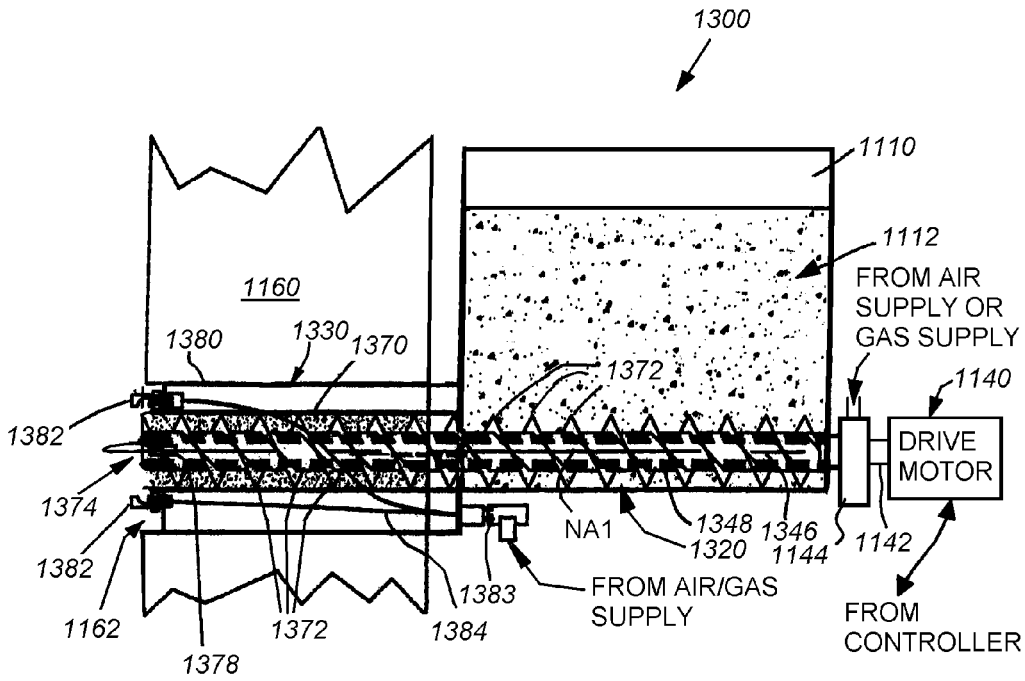
FIG. 13 is a side view of a nozzle assembly according to another illustrative embodiment.
Figure 14:
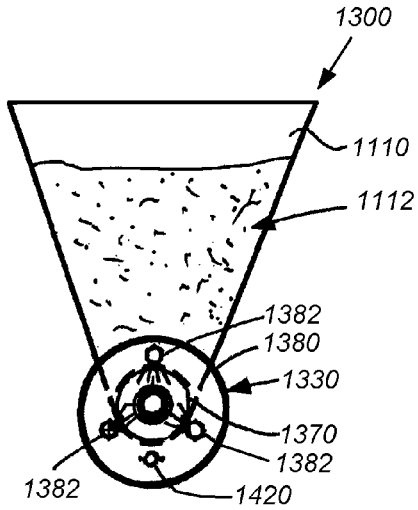
FIG. 14 is a rear, downstream, view of the nozzle of FIG. 13 depicting the nozzle tip.

FIGS. 13 and 14 depict a nozzle assembly 1300 according to an alternate embodiment. In general, the drive motor and hopper are substantially similar to those described with reference to FIGS. 11 and 12. Thus, the same reference numbers for these components are employed. The feed screw 1320 includes a shaft 1348 and helical lands 1372. The shaft 1348 can be hollow (central space 1346) to allow for a supply of gas or air from the coupling 1142. This flow is optional in this embodiment. Illustratively, the tip 1374 of the shaft 1348 can be open to allow positioning of an igniter 1378 according to a conventional design. If so, the coupling 1142 can deliver a supply of gas for use with the igniter spark.

The downstream portion of the nozzle assembly includes a casing 1330 that extends through the cap 1160, via the port 1162. The casing 1330 consists of an inner cylinder that conforms to the screw lands 1372. This space, between the shaft 1348 and the inner wall of the cylinder 1370 forms the conduit for flow of the mixture 1112. The casing also includes an outer, coaxial shell 1380 that supports a set of air (and optionally gas) nozzles 1382 with deflectors that direct the airflow inwardly toward the axis NA1 to generate atomization and air-mixing. In this embodiment, the nozzles 1382 are located at 120-degree spacing around the axis NA1. They can be located at a variety of positions and more or less than three nozzles can be employed in alternate embodiments. The nozzles are fed by one or more valves or couplings 1383 via hoses 1384. A variety of interconnection arrangements can be employed in a manner clear to those of ordinary skill. The nozzles can be arranged and/or controlled selectively to generate a directional fireball as described above. In an optional implementation as shown in FIG. 14 an additional nozzle or air supply 1420 can be provided at the bottom of the casing 1330. This can also be an alternate location for the igniter.

Reference is now made to FIGS. 16 to 19, which show a nozzle assembly 1100 according to an illustrative embodiment that provides a particularly effective nozzle cone geometry for generating and spreading a solid-containing-liquid-fueled flame within a furnace, including, but not limited to the furnace impairments described hereinabove. In general, any of the various nozzle assemblies described herein can be used in conjunction with the illustrative furnace 100, 700 described above (or in conjunction with any other variation on the furnace contemplated herein). In the depicted embodiment of FIGS. 16 to 19, the nozzle assembly 1600 includes of a funnel-shaped hopper 1610 that maintains a relatively continuous level of the solid and oil fuel material mixture 1612 as described previously. The level of feed material is highly variable, but is generally maintained so that there is continuous coverage of the upstream end of the feed screw 1620. Additionally, the level should provide sufficient weight to ensure that the material is continuously urged by gravity into engagement with the feed screw 1620 as it is carried downstream out of the hopper 1610. As also described above, the material in the hopper can be continuously replaced by a second conveyor (not shown) that can draw material from a larger source (a dump truck or tank truck, for example), and provide new mixture in response to the current level in the hopper 1610, so as to maintain a relatively constant fill range at all times. This second conveyor (not shown) can be any acceptable design including a slurry pump and hose, a feed screw and/or a belt conveyor. The amount of feed mixture maintained in the hopper can be determined by experimentation for a given feed rate, and based upon the size and shape of the feed screw 1620.

Figure 16:
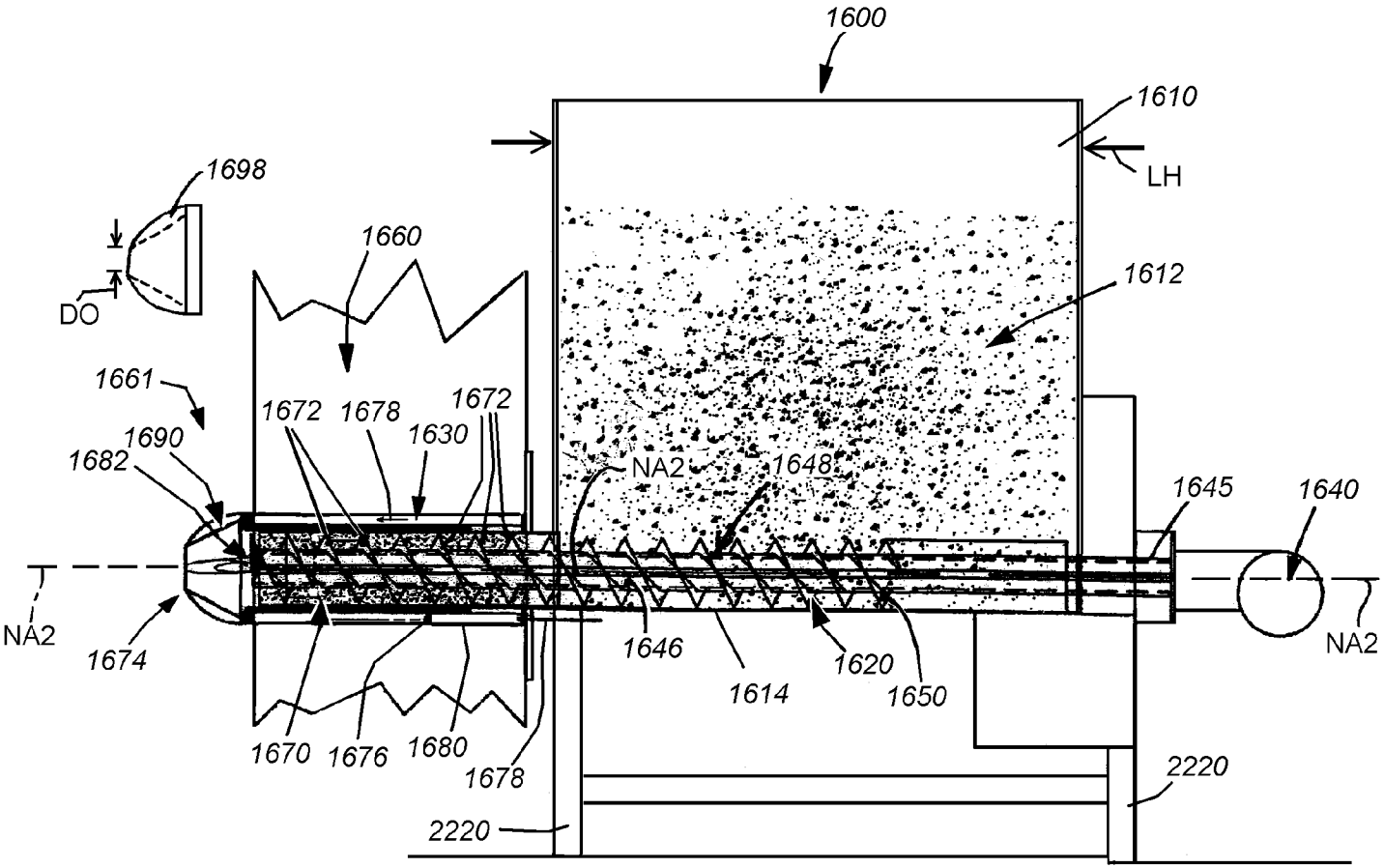
FIG. 16 is an exposed side view of a nozzle assembly according to illustrative embodiment.
Figure 17:
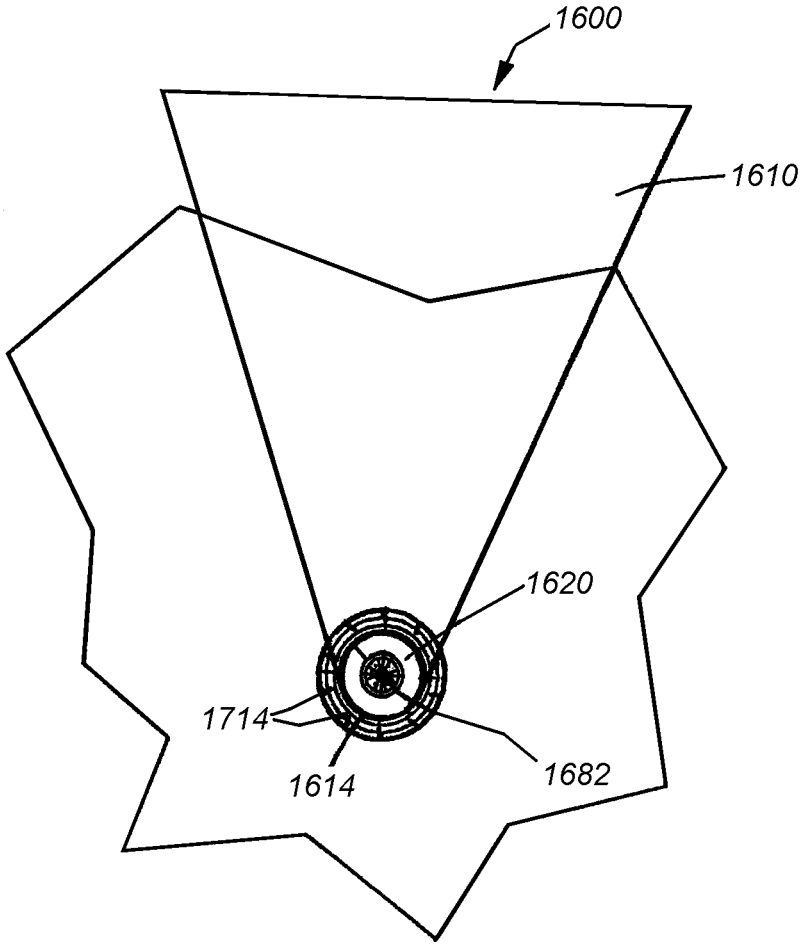
FIG. 17 is a rear, downstream, view of the nozzle of FIG. 16 depicting the hopper and nozzle tip.

The geometry of the hopper 1610 (as described above) defines a wide top that narrows into a bottom 1614 that is curved to conform to the cylindrical outer dimension of the feed screw 1620. FIGS. 16 and 17 illustrate the shape of the hopper 1610 according to one of a variety of possible hopper geometries. In this manner, all the material loaded into the hopper is driven by the weight of the overlying material into a concentrated, pressurable engagement with the screw. It should be clear that a variety of mechanisms for ensuring the screw is properly fed can be implemented in alternate embodiments. For example, a biased piston or plate can be used to force material into contact with the screw. Also, as previously described an agitator device (not shown) can be operatively connected to the hopper 1610, and is used to assist in maintaining the solids in suspension as the feed material is supplied to the feed screw. It should be clear that a variety of agitation devices can be employed, such as an agitating beater that rotates within the hopper, or a shaker that vibrates the hopper 1610.

In this embodiment the feed screw 1620 is driven by a drive motor assembly (not shown in FIG. 16, but see FIG. 13 above by way of example) typically located beyond the rear end of the hopper 1610, which receives drive signals from a controller (described above) so as to variably control its speed and/or operation. The motor can be any acceptable motor with appropriate reduction gears and/or power transmission components that interconnect with the shaft. The motor is typically electrically driven, but other types of motors (such as hydraulic or compressed air motors for example) can be employed in alternate embodiments. More particularly, the motor can be interconnected to a drive axle 1645 that extends into a sealed air feed coupling structure. This coupling structure allows a pressurized fuel/air mixture (including atomized fuel oil or gas) to be injected into the hollow center 1646 of the feed screw shaft 1648 by a blower assembly 1640, using which exits downstream of the coupling to provide a coaxial pilot light and igniter at the tip 1682. Appropriate bearings and seals that should be clear to those of ordinary skill are used to seal the coupling between the shaft and the blower 1640. As described above, this pilot light helps to initially heat the furnace chamber and provide ignition to the main fuel/solid material as it is ejected from the nozzle under pressure. While the pilot light/igniter 1682 is aligned with the nozzle's longitudinal axis NA2 (also the feed screw axis of rotation), in alternate embodiments the pilot light/igniter can be provided on the exterior of the nozzle casing and directed into the combustion chamber of the furnace. It can be located aside, above or below the nozzle outlet, and can extend parallel to the axis NA2 of the nozzle, or at an inwardly directed angle to the axis NA2.

The exterior of the feed screw shaft 1648 supports a continuous helical strip 1650 that is secured to the shaft 1648 by welding or another acceptable technique. Stainless steel or another durable material can be employed form both the helix 1650 and the shaft 1648. Alternatively, the screw 1620 can be constructed as a unitary member using machining techniques or another acceptable manufacturing process. More generally, the feed screw 1620 can be constructed with principles clear to those of skill.

The feed screw's helix can extend the full length LH of the hopper 1610 or can extend a significant portion of the length of the hopper as shown, with the upstream end defining a straight axle. The feed screw 1620 exits downstream into the nozzle casing 1630 that passes through the cap 1660 at the front of the primary chamber 1661 of the furnace via a port. The casing 1630 includes an inner cylinder 1670 that closely conforms to the outer edge of the helix 1650, thereby containing the mixture 1612 between the helix lands 1672 as the screw rotates to drive the mixture downstream to the nozzle outlet tip 1674. The casing 1630 also includes a coaxial outer shroud 1680, which is separated from the inner casing 1670 so as to define therebetween an annular air chamber or plenum 1676. See in FIG. 16 the arrow 1678 that depicts the direction of air flow through the coaxial plenum toward the outlet tip. Compressed air at a predetermined flow rate and pressure can be coupled from a distribution header similar to the header 1184 depicted in the embodiment described in FIG. 11. This distribution header receives air from a compressor or other pressurized air supply. In some embodiments, the pressurized air can be mixed with flammable gas to enhance the burning of the solid/fuel material at certain times—for example upon startup—or on a continual basis where more heat is needed to maintain combustion. This additional heat can also be provided via the central pilot light.

A set of ports 1714 are provided to direct pressurized air and/or gas into the fuel mixture as it exits the nozzle tip under pressure due to the momentum imparted by the rotating feed screw 1620. While the ports 1714 are all fed from the common plenum 1676, in an embodiment, some or all of the ports 1714 can be independently fed with gas and/or air so that the bias of pressurized air/gas exiting the casing 1630 can be varied around the perimeter. To effect selective flow in various ports, the plenum can include radial walls that separate it into different chambers each associated with one or more discrete ports. The air supply to each plenum chamber is then discretely controlled by a header or other structure. In another embodiment, the ports can be fed by individual hoses or tubes (see FIG. 13) connected to an air compressor, and optionally serviced by separate valves (not shown). In operation, more pressure can be applied at one side of the nozzle than another, allowing the creation of a directional fireball and/or vortex within the combustion chamber.

Figure 18:
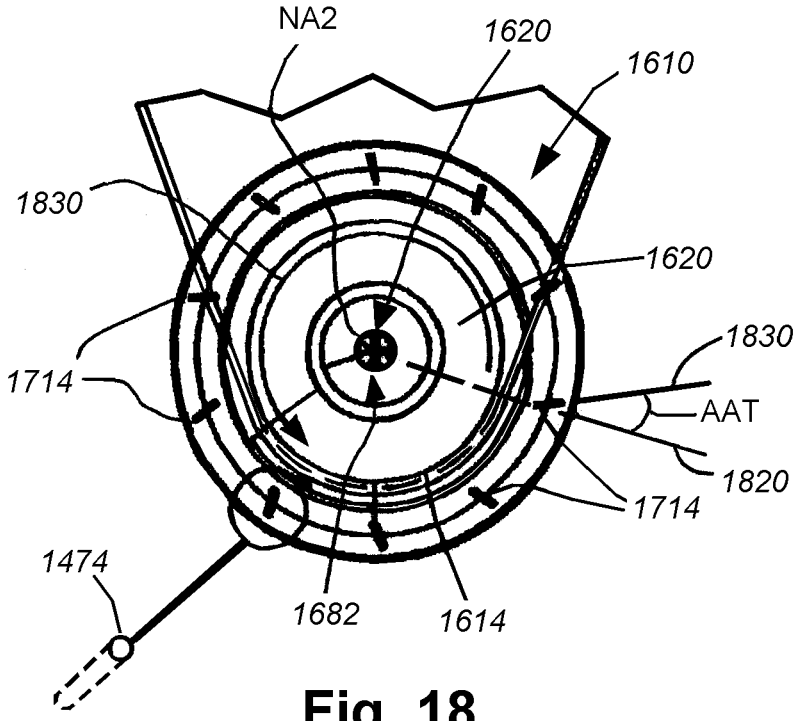
FIG. 18 is a fragmentary enlarged front view of the nozzle assembly of FIGS. 16 and 17.

In this embodiment, and with reference also to the exposed frontal view of FIG. 18, the ports 1714 are bored so as to direct their flow inwardly toward the central axis NA2 of the nozzle. That is, they are tilted along the radial plane (through axis NA2) to define an angle AAN with respect to the axis NA2. As will also be described below, the ports are tilted axially to generate a swirling vortex of airflow (arrow 1940 in FIG. 19).

As described above, the ports 1714 operate to provide further make-up air and help to impel the ejected mixture into the airspace of the combustion chamber 1661. The pressure and airflow utilized is highly variable. The precise levels of pressure and airflow can be determined experimentally for a given size and output of furnace and specific characteristics of the feed material. They can be varied based upon the measured temperature and other parameters within the furnace by the controller (160, 770). More particularly, a plurality of variables is accounted for in determining pressure, mixture feed rate, and other operational parameters. These variables described above in connection with the embodiment illustrated in FIGS. 11 and 12, as well as the use of a pilot/igniter 1682 which receives signals from the controller in order to activate an electrical spark. More particularly, the amount of pressure utilized at the ports can vary based upon such factors as the adhesion of the material and its fuel content, as well as the type of fuel (e.g. sweet crude, oil shale, etc.). A material with low cohesiveness and relatively high grade fuel can be effectively atomized with as little as 3-10 psi, while a highly dense and/or cohesive material with lower grade fuel can require 30-50 psi to form a desired fireball.

In this illustrative embodiment, the nozzle outlet tip includes a novel nozzle cone assembly 1690 that is arranged symmetrically relative to the lead screw axis 1649 and the igniter 1682. Refer to the somewhat enlarged fragmentary views of FIGS. 18 and 19 for further details of the structure at the overall nozzle tip including the port (1714) arrangement and its coupling to the annular air chamber or plenum 1676 of the cylindrical nozzle casing. The nozzle cone assembly 1690 can be a structure that includes both a distal (with respect to the feed direction) tapering conical section 1692 and a port section 1694 at its proximal base. Both of these sections may be formed unitarily as a single casting or machining, or as an integral unit that is formed from separate pieces and then joined together. Both sections can be constructed of a high-temperature, wear-resistant material such as stainless steel, Carlson nickel alloy 330, ceramic, or another appropriate material. The annular port section 1694 can be attached to the very distal end of the cylindrical casing 1670 so that ports 1714 are in fluid communication with the annular air chamber or plenum 1676 where compressed air is directed. The annular port section 1694 can be attached by a screw fit, force fit with detents, clamps, welds, or in any other suitable manner so that the nozzle cone 1690 is secured in place. By using a separate nozzle cone, it is possible to readily substitute alternate cone structures having different port arrangements depending upon the particular materials being fed or other parameters of the process.

Figure 19:
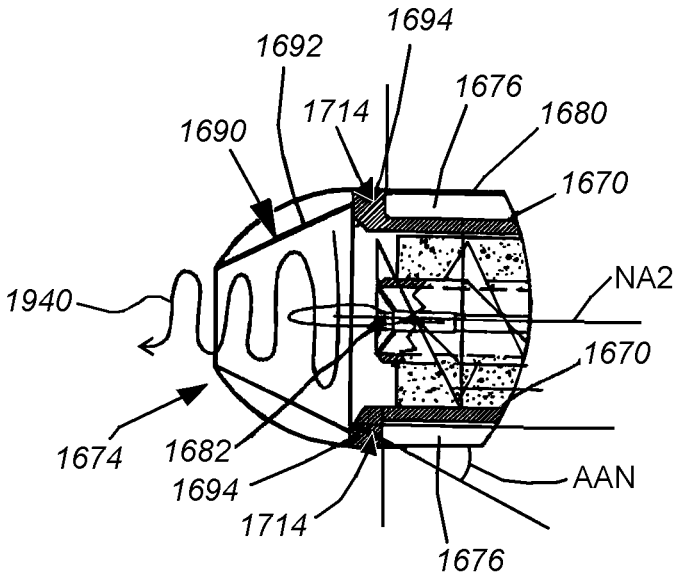
FIG. 19 is a fragmentary enlarged exposed side view at the nozzle outlet and associated nozzle cone of the nozzle assembly of FIGS. 16 and 17.

The cross-sectional view of FIG. 19 illustrates opposed ports 1714 disposed in the port section 1694. The number of ports or holes 1714 can be varied. The number will depend, inter alia, on the overall diameter of the nozzle structure. Ten ports are employed in this illustrative embodiment. However, this number is highly variable and more or fewer can be employed. The diameter of each port hole may be on the order of approximately ⅛ inch in diameter. The diameter can be in a range of 1/16 inch to ¼ inch in various embodiments. As can be observed in FIG. 19, the ports 1714 are tilted radially in order to promote a cleaning of the inner surface of the conical section 1692 as the air flows generally parallel to the surface to converge at the axis NA2, and to also maintain the desired air velocity, particularly over the full length of the inner conical surface. As also illustrated in FIG. 19, the radial tilt or angle of the ports 1714 substantially matches the inside pitch or slope angle of the conical section 1692. In various embodiments, the ports 1714 can define a radial tilt or angular displacement in a range of approximately 25 to 45 degrees to the axis NA2. This tilt angle is depicted in the view of FIG. 19. In addition, the ports 1714 can illustratively tilt out of the axial plane, i.e. tilt in a direction out of the plane of FIG. 19. This is illustrated in FIG. 18 wherein the cylindrical nozzle passage or bore is tilted in that direction and relative to axial flow of the air stream. Note that the ports 1714 are shown as exposed along their length for clarity in depicting the axial tilt in FIG. 18. The actual port end is a circular aperture and the port passes through the nozzle base 1694 as a cylindrical bore. The detail view of a port 1714 at the bottom left of FIG. 18 indicates this by showing the exposed port opening as a solid shape and the cylindrical bore as a dashed structure, since it is not actually visible. The degree of axial tilt is variable. In various embodiments the depicted angle AAT (FIG. 18) between a radius line 1820 and the alignment of the port 1830 can be between approximately 5 and 25 degrees. However, the tilt can equal approximately 0 degrees, or be greater than 25 degrees in alternate embodiments. The tilt can vary from port-to-port about the perimeter of the cone to achieve greater turbulence. Notable, by tilting the ports 1714, the nozzle outputs collectively impart a rotary or swirling motion (arrow 1940 in FIG. 19) to the material exiting the nozzle cone 1692, which assists in atomizing the material and providing higher velocity operation. The tilt can be in either direction so as to impart either a clockwise motion or a counterclockwise motion. Likewise, since the material exits the screw with little rotation (until imparted by the airflow), the port axial tilt can cause airflow in the rotational direction of the screw, or in a counter direction, as illustrated by screw rotation arrow 1830 in FIG. 18.

As a further design consideration, it is desirable to construct the cone with a relatively short axial length to ensure that the material exits at high velocity and ensure the flame remains full and robust. For example, the axial length is shorter than the maximum inner diameter. In an embodiment, the cone (1690) is arranged to decrease in inner diameter over the length from inlet to the outlet of approximately 50 percent. This is highly variable depending upon the characteristics of the material being fired (e.g. material cohesiveness and density, fuel content, fuel quality, etc.). It is contemplated that the nozzle assembly can accommodate a plurality of standard or customized cone assemblies. For example, a second cone assembly 1698 with a larger diameter reduction and smaller outlet diameter DO, can be appropriate to certain types of material. The user or manufacturer can mount this cone 1698 (or another alternate cone) as appropriate to the material being fired. The associated ports of a second cone with a differing geometry can be tilted both radially and axially at angles that particularly suit the characteristics of the material and the slope of the cone's inner surface. Through experimentation, a wide range of angle and tilt values can be established for different types of material. This can be information can be associated with geographic areas. Thus, for furnaces operation in Texas, a certain default cone is specified, while furnaces operating in the South America can specify a different-geometry cone depending on the characteristics of the local sludge.

Figure 20:
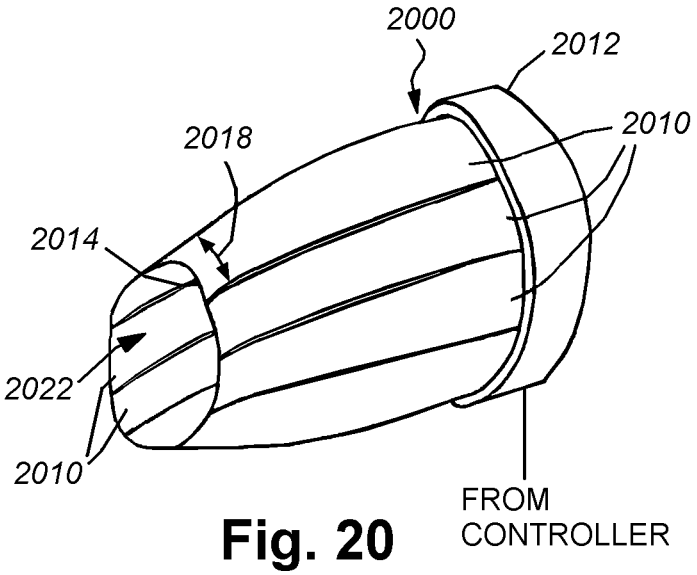
FIG. 20 is a somewhat schematic perspective view of a nozzle cone having a variable geometry according to an illustrative embodiment.
Figure 21:
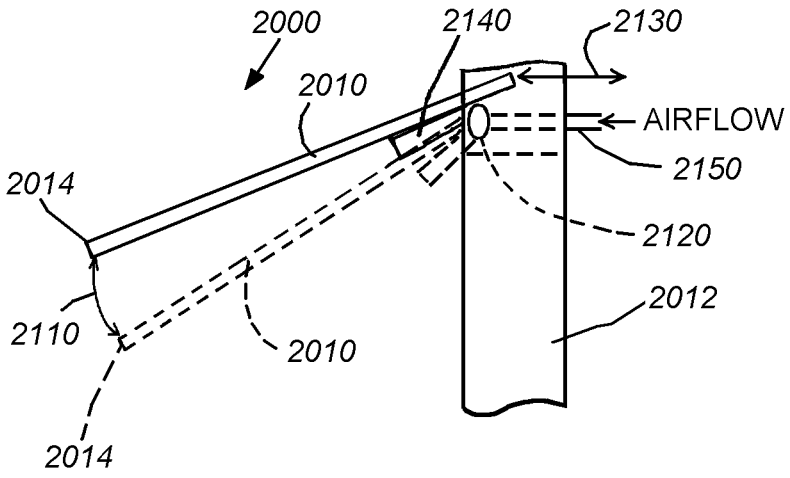
FIG. 21 is a fragmentary schematic cross section of the movement of a petal of the variable geometry nozzle of FIG. 20.

According to an alternate embodiment, shown schematically in FIGS. 20 and 21, the nozzle cone can be provided with a variable geometry that allows the user to adjust the pitch or slope of the conical surface within a predetermined range (double arrow 2110). Again, the adjustment in pitch on the cone's inner surface can be dictated by the particular material being fired. Such an adjustment can be used to affect the shape and location of the fireball that is generated within the fire chamber. As shown, the illustrative nozzle cone 2000 is separated into a plurality of side-by-side inter-connected cone segments or petals 2010. These cone segments are individually controllable by sliding relative to an adjacent petals so as to open and close the distal opening 2022. The nozzle cone may be considered as having a proximal end 2012 and a distal end 2014. The proximal end 2012 can be a fixed base, such as at the port section 1694 shown in FIG. 19. In this embodiment, the base 2012 includes a plurality of pivots or hinges 2120 that allow the petals to hinge as shown generally in FIG. 21. An actuation mechanism (not shown) is attached to each petal and imparts a force (double arrow 2130) that causes each petal to open or close as appropriate. This actuation force can be provided by an acceptable device capable of withstanding the heat generated by the nozzle and surrounding combustion chamber. For example an electromechanical linkage, a pneumatic piston or a hydraulic ram can be used. The ring can include a plurality of ports with pistons that move in response to an applied fluid pressure. The working fluid can be a conventional hydraulic fluid, a high temperature fluid or even a low-melting point metal. As shown, the air ports are provided with variable pitch by locating each of them in a housing 2150 along the inner surface of a respective petal 2010. Each port's airflow passes through a perforated passage in the hinge 2120 that is fed by a feed port or other opening 2150 in communication with the above-described plenum (1670), or another air distribution structure. When actuated, the distal ends 2014 of the petals 2010 can move relative to an adjacent petal to vary the overall outlet diameter (opening 2022) of the cone surface at the distal end 2014. The movement of the petals 2010 can be collective, or individual, depending upon whether the actuation mechanism moves all petals 2010 together or is subdivided to actuate one or more discrete petals. The movement is depicted generally in FIG. 20 by the transition arrow 2018 illustrating the distal ends of petals 2010 moving relative to each other to open or close the opening 2022. The inner surface shape of the petals ensures that that seal with respect to each other as they move through a range of angles. The control of the actuation mechanism is schematically illustrated in FIG. 20 by the control line 2020 coupled from the controller. In general, those of skill will recognize that an "iris nozzle", such as that which is employed in jet aircraft can form the basis for the design of the cone 2000. Other alternative variable geometry designs are expressly contemplated, and should be clear to those of skill. Notably, when petals 2010 are controlled individually, they can be directed to steer the flame in the manner of a vectored thrust system.

It should be clear that a nozzle cone as shown and described in accordance with the various embodiments herein provides increased velocity to ejected material, enhancing its break up and atomization for a more-effective combustion flame. The use of ports that create a spinning vortex further enhances atomization and breakup for greater efficiency.

Figure 22:
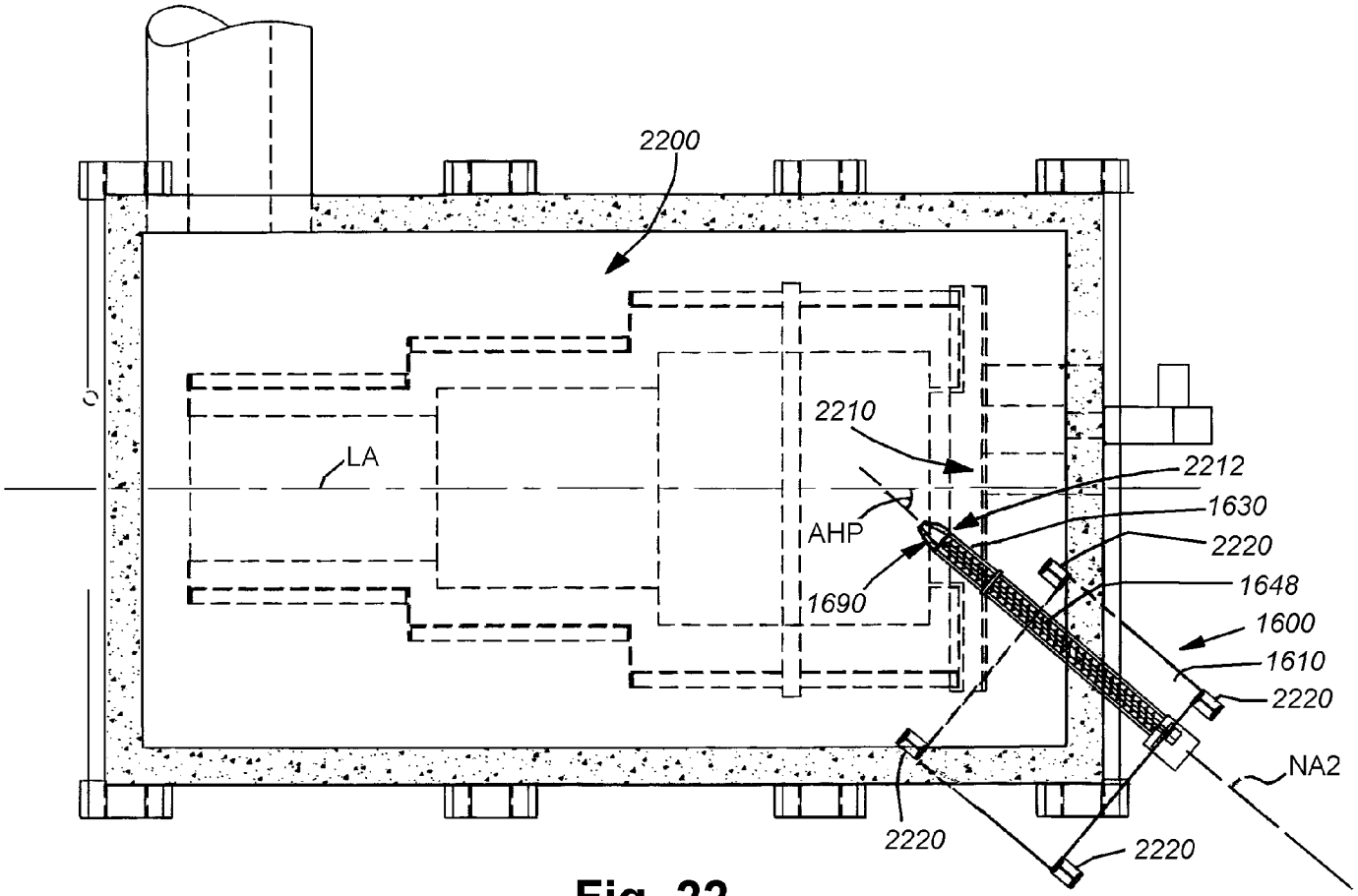
FIG. 22 is an exposed top view of an embodiment of the nozzle and nozzle cone of FIGS. 16 and 17, shown directed at an acute, non-perpendicular angle with respect the longitudinal axis of rotation of the furnace.

Reference is now made to FIG. 22, which shows the nozzle assembly 1600 of the embodiment of FIGS. 16-19 (although other nozzle embodiments can be substituted) mounted so as to direct flow therefrom at a non-perpendicular angle AHP within the horizontal plane (i.e. a horizontal plane approximately parallel to the plane of the drawing page and/or floor/ground surface) relative to the longitudinal axis LA of the illustrative kiln 2200. Any kiln contemplated herein can be substituted for the depicted kiln in alternate embodiments. The nozzle casing 1630 extends through a port 2212 in the cap 2210. The port 2212 can be sealed using any acceptable technique including a moving pivoting turret arrangement similar to a sponson-mounted naval gun. Conversely the port can define a hole or slot in the cap that is relatively unsealed. Notably, the nozzle assembly 1600 can be mounted on legs 2220. The leg arrangement allows the nozzle to be positioned at a plurality of variable angles AHP within the horizontal plane. As depicted the angle AHP is approximately 50 degrees. Illustratively the range of angle AHP can be between approximately 0 degrees (nozzle axis NA2 in line with the kiln axis LA) and approximately 65 degrees. This range is illustrative, and a larger or smaller range can be contemplated. Likewise, the nozzle assembly can be movable/adjustable between angular positions or fixed in a desired position. Where adjustable, the legs can optionally include pads or rollers to aid in adjustment of the angle AHP to optimize combustion. A semi circular track or rail assembly can also be employed to guide rollers supporting the nozzle assembly 1600 as the assembly is swung through an arc. Likewise, the angle AHP can be defined on either side of the kiln axis LA.

Note that for the purposes of this description, the nozzle axis NA2 actually defines angle AHP with respect to a vertical plane take through kiln axis LA, as the axis LA descends downwardly. For the purposes of this description, the angle AHP in an approximate horizontal plane shall be described with respect to the kiln axis LA in the broad sense that it represents the vertical plane therethrough. The angle AHP can also be expressed as an angle with respect to the plane of the cap 2210 by adding approximately 90 degrees.

Illustratively of angling the nozzle can ensure that any relatively heavy particles within the material (e.g. heavy sand and other particulate/clay-based matter) will drop to the kiln floor sufficiently close to the flame in the primary chamber. As such, the combustibles in this material are more likely to be fully consumed by the time this material reaches the far (outlet) end of the primary chamber.

The various features of the nozzle assemblies 1100, 1300, 1600 described above can be combined or modified to create an efficient and optimized implementation for directing fuel and air into the primary combustion chamber, and also to ignite and maintain the fireball. While not shown, a variety of seals and insulating components can be provided at the port 1162, 2212 to ensure that there is no leakage of excess heat, fuel or burning materials into the outside environment.

It should also be noted that the various embodiments of novel, screw-feed nozzle assembly contemplated herein can be applied separately to a variety of applications for injecting a viscous mixture of solids and liquids into a process chamber—such as a general purpose disposal kiln. This nozzle construction can be used as an efficient substitute for a piston or ram-type feeder, and allows for more continuous and controlled feeding at relatively high pressures than prior implementations.

IV. Cogeneration Process

Figure 15:
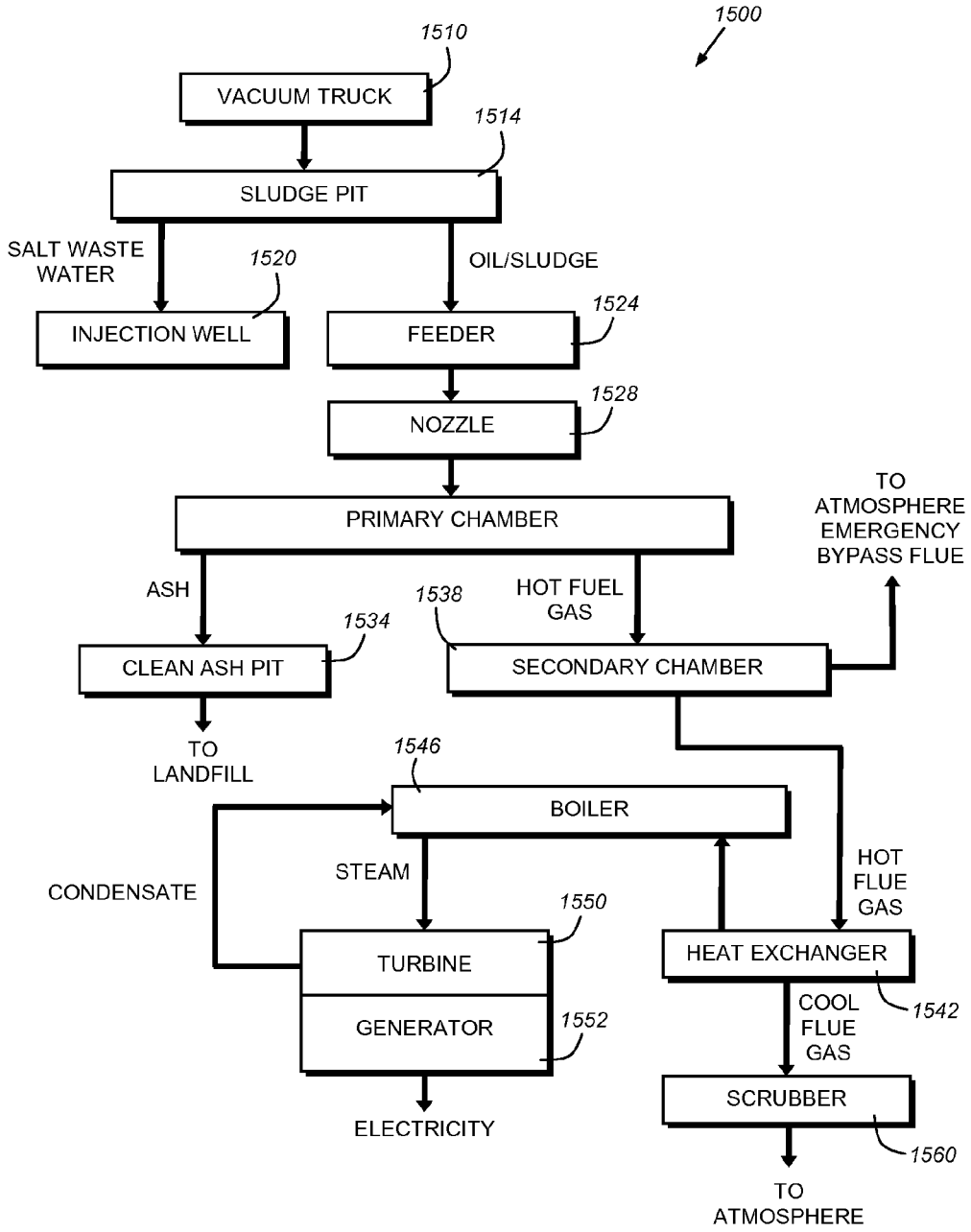
FIG. 15 is a block diagram of an overall oil sludge cogeneration process according to an illustrative embodiment.

Having described the components and operation of the furnace and associated nozzle assembly according to illustrative embodiments, a system and method for cogeneration of power using a fuel composed of a mixture of solid particulates and oil (such as oil sludge) is now described in further detail with reference to FIG. 15.

As shown, the overall cogeneration and reclamation process 1500 begins with the operation of a vacuum truck (1510), which delivers oil sludge from an oil well site to a sludge pit (1514) after it is removed by the vacuum from the well site's storage tanks. The briny waste water is removed by dewatering and drawn/sucked away. It is then provided to an injection well or otherwise disposed of (1520). The dewatered sludge is directed via a conveyor system to the feed hopper (1524). The level in the hopper is maintained within a desired level to provide sufficient pressure to the feed screw. The feed screw then delivers the sludge mixture to the nozzle tip (1528) and into the primary combustion chamber with the addition of pressurized air (1530). The mixture is combusted and the slag migrates to the outlet port where it is removed as clean ash that exits through the water filled pit and conveyor assembly (1534). The ash can be transported to a landfill as clean fill. While certain inorganics (heavy metals such as chromium, vanadium, etc), may be present, these components can be more readily contained in the ash, than in a sludge mixture where they may be suspended in the oil. Contemporaneously, the hot fuel and exhaust gasses flow into the secondary combustion chamber (1538). The hot, fully combusted gasses exit the secondary combustion chamber via the flue and are passed through a heat exchanger (1542) that drives a boiler (1546) and thence to a scrubber or baghouse before being exhausted to the atmosphere. In the event of emergency and/or boiler shutdown, the flue gasses can bypass the heat exchanger via a bypass flue that vents directly to the atmosphere. The boiler generates process steam that drives a turbine (1550), which drives an electrical generator (1552). The electricity is interconnected to the power grid and/or used locally to operate oil field equipment. The condensed water from process steam is recycled through the boiler and reheated by the flue in a continual cycle. The cool flue gasses exit the heat exchanger and are optionally passed through a scrubber (1560), which can be conventional in design, and which removes any residual ash, particulates and pollutants. The CO2 byproduct can be subjected to sequestration as a further option, and the water vapor can be reclaimed.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, while the interior of the primary combustion chamber is polygonal and stepped or tapered, it is expressly contemplated that the interior of the primary combustion chamber can be partially or entirely curvilinear in cross section with no corner joints between planar segments. Alternatively, the interior of the primary combustion chamber can be a continuous perimeter (non-tapered and/or non-stepped) along its length, or a significant portion of its length. Significantly, as used herein the term "mixture" of solids and liquid organics can be defined broadly to include other sources of energy that are suspended in a solid matrix. For example, oil sands and oil shale can be processed (using, for example breaking and grinding) to produce a material suitable for feeding by the nozzle assembly and directed to the furnace for production of heat without requiring substantial and costly separation techniques to extract the liquid oil from the solids. The size and consistency of ground particles can be varied based upon the oil content in the matrix and/or the combustion characteristics of the mixture. The principles herein can also be employed in an off-shore drilling environment to power the well operation and reduce storage of sludge. Accordingly, this description is meant to be taken only by way of example, and not to otherwise limit the scope of this invention.

What is claimed is:

1. A nozzle assembly for feeding a mixture of solid particulates and oil to a combustion location under pressure comprising:

a screw feed that rotates at a predetermined rate to direct the mixture from a source location down a screw feed casing to a tip from which the mixture is ejected, the screw feed extending an entire length of the screw feed casing;

a plurality of air ports surrounding the tip, at a location external of the screw feed casing that direct pressurized air in a selected quantity into the mixture as it is ejected from the tip;

an igniter that directs a pilot flame into the mixture as it is ejected from the tip; and a nozzle cone that is disposed about the tip and that extends beyond the air ports;

wherein the nozzle cone comprises a distal conical section and an annular port section that is proximal to and contiguous with said conical section, an entirety of the conical section extending beyond all of the plurality of air ports and the annular port section supporting the plurality of air ports;

wherein the air ports are located between the screw feed casing and an outer casing coaxial with the screw feed casing, the air ports being constructed and arranged to direct the air flow inwardly toward a rotational axis of the screw feed.

2. The nozzle assembly as set forth in claim 1 wherein the air ports comprise a plurality of discrete directional ports interconnected with respective hoses.

3. The nozzle assembly as set forth in claim 2 wherein the directional ports are interconnected, respectively with selectively controlled air sources.

4. The nozzle assembly as set forth in claim 1 wherein the source location of the mixture comprises a hopper that provides a predetermined level of the mixture to an exposed portion of the feed screw.

5. The nozzle assembly as set forth in claim 1 wherein the feed screw includes a hollow central shaft in communication with a source of pressurized air and having a plurality of air ports at a tip thereof that directs the pressurized air into the mixture as it is ejected from the tip.

6. The nozzle assembly as set forth in claim 1 wherein the tip directs the mixture into a front of a rotating primary combustion chamber that is interconnected with a secondary combustion chamber via a passage adjacent to the front.

7. The nozzle assembly as set forth in claim 6 wherein the mixture comprises oil and inorganic solids.

8. The nozzle assembly as set forth in claim 7 wherein the mixture comprises oil sludge.

9. The nozzle assembly as set forth in claim 1 wherein the non-conical port section is annular, the screw feed casing is cylindrical, and the nozzle cone is removably attached to a distal end of the cylindrical casing.

10. The nozzle assembly as set forth in claim 1 wherein the nozzle cone is adjustable as to its pitch.

11. The nozzle assembly as set forth in claim 9 including an annular air plenum disposed about the cylindrical casing for directing compressed air to the plurality of air ports.

12. A nozzle assembly for feeding a mixture of solid particulates and oil to a combustion location under pressure comprising:

a screw feed that rotates at a predetermined rate to direct the mixture from a source location down a screw feed casing to a tip from which the mixture is ejected, the screw feed extending an entire length of the screw feed casing;

a plurality of air ports surrounding the tip, at a location external of the screw feed casing that direct pressurized air in a selected quantity into the mixture as it is ejected from the tip;

an igniter that directs a pilot flame into the mixture as it is elected from the tip; and a nozzle cone that is disposed about the tip and that extends beyond the air ports;

wherein the nozzle cone comprises a distal conical section and an annular port section that is proximal to and contiguous with said conical section, an entirety of the conical section extending beyond all of the plurality of air ports and the annular port section supporting the plurality of air;

wherein the ports are tilted angularly with the angle of tilt substantially matching the pitch of the conical section.

13. A nozzle assembly for feeding a mixture of solid particulates and oil to a combustion location under pressure comprising:

a screw feed that rotates at a predetermined rate to direct the mixture from a source location down a screw feed casing to a tip from which the mixture is ejected, the screw feed extending an entire length of the screw feed casing;

a plurality of air ports surrounding the tip, at a location external of the screw feed casing that direct pressurized air in a selected quantity into the mixture as it is ejected from the tip;

an igniter that directs a pilot flame into the mixture as it is ejected from the tip; and a nozzle cone that is disposed about the tip and that extends beyond the air ports;

wherein the nozzle cone comprises a distal conical section and an annular port section that is proximal to and contiguous with said conical section, an entirety of the conical section extending beyond all of the plurality of air ports and the annular port section supporting the plurality of air;

wherein the ports have both a radial tilt relative to the lead screw longitudinal axis and an axial tilt relative to the lead screw longitudinal axis.

14. The nozzle assembly as set forth in claim 1 wherein the combustion location defines a rotating primary combustion chamber of a kiln and the lead screw longitudinal axis is directed into the combustion location at a non-perpendicular angle AHP within an approximate horizontal plane with respect to a longitudinal axis LA of rotation of the kiln.

15. The nozzle assembly as set forth in claim 14 wherein the primary combustion chamber includes a stationary cap having a port through which at least a portion of a casing of the nozzle and the nozzle cone extends, the port being constructed and arranged to allow variable adjustment of the angle AHP.

16. The nozzle assembly as set forth in claim 12 wherein the ports have both a radial tilt relative to the lead screw longitudinal axis and an axial tilt relative to the lead screw longitudinal axis.

17. The nozzle assembly as set forth in claim 1 wherein the plurality of air ports are spacedly disposed about the non-conical port section, and the conical section is free of any ports.

18. The nozzle assembly as set forth in claim 17 wherein each of the ports has an outlet aperture that is constructed and arranged to promote the cleaning of the inner surface of the conical section by directing air flow over a full length of the inner surface of the conical section.

19. The nozzle assembly as set forth in claim 18 wherein the air flow is generally parallel to the inner surface of the conical section.

20. A nozzle assembly for feeding a mixture of solid particulates and oil to a combustion location under pressure comprising:

a screw feed that rotates at a predetermined rate to direct the mixture from a source location down a screw feed casing to a tip from which the mixture is ejected;

a plurality of air ports surrounding the tip, at location external of screw feed casing that direct pressurized air in a selected quantity into the mixture as it is ejected from the tip;

an igniter that directs a pilot flame into the mixture as it is ejected from the tip;

wherein the air ports comprise a plurality of discrete directional ports interconnected with respective conduits;

wherein the directional ports are interconnected, respectively with selectively controlled air sources;

and a controller that controls air flow through respective of the air ports so as to direct the pressurized air in a directional pattern.

* * * * *